US009983528B2

(12) United States Patent
Harano

(10) Patent No.: US 9,983,528 B2
(45) Date of Patent: May 29, 2018

(54) PRINTING SYSTEM, METHOD OF CONTROLLING THE SAME, AND STORAGE MEDIUM

(71) Applicant: CANON KABUSHIKI KAISHA, Tokyo (JP)

(72) Inventor: Yuzo Harano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/205,310

(22) Filed: Jul. 8, 2016

(65) Prior Publication Data

US 2017/0023898 A1 Jan. 26, 2017

(30) Foreign Application Priority Data

Jul. 24, 2015 (JP) ..... 2015-147082

(51) Int. Cl.
*G03G 15/00* (2006.01)
*B42C 19/00* (2006.01)

(52) U.S. Cl.
CPC ..... *G03G 15/50* (2013.01); *B42C 19/00* (2013.01); *G03G 15/6544* (2013.01); *G03G 2215/00822* (2013.01); *G03G 2215/00936* (2013.01)

(58) Field of Classification Search
CPC ..... G03G 2215/00822; G03G 2215/00827; G03G 15/6541; G03G 15/6544; G03G 2408/12; G03G 2215/00936; B65H 2408/12; B65H 2408/121; B65H 2301/163; B65H 2301/1635; B42C 19/00
See application file for complete search history.

(56) References Cited

U.S. PATENT DOCUMENTS 5,713,061 A * 1/1998 Yoshioka ..... G03G 15/231 399/364
8,049,920 B2 * 11/2011 Yamaguchi ..... H04N 1/387 358/1.13
2005/0232656 A1 * 10/2005 Asai ..... B42C 19/02 399/130
2009/0051098 A1 * 2/2009 Toda ..... G03G 15/6544 270/37
2012/0038942 A1 * 2/2012 Umetsu ..... G03G 15/5087 358/1.13
2012/0212762 A1 * 8/2012 Tsukuba ..... H04N 1/00347 358/1.13
2012/0268792 A1 * 10/2012 Ozaki ..... G06F 17/217 358/1.18

(Continued)

FOREIGN PATENT DOCUMENTS

JP 2012-000773 A 1/2012

*Primary Examiner* — David Banh
(74) *Attorney, Agent, or Firm* — Fitzpatrick, Cella, Harper & Scinto

(57) ABSTRACT

A printing system obtains a print job, analyzes the obtained print job, and imposes print pages to a total of four surfaces of a print target sheet including two surfaces on each of front and back in accordance with a bookbinding format of the analyzed print job. As for an imposition method, if the bookbinding format of the print job is particular two fold bookbinding for which processing of two-folding a sheet and bonding a plurality of two-folded sheets is performed, imposition is performed while reserving a glue surface not to print out of the four surfaces of the print target sheet.

16 Claims, 16 Drawing Sheets

(56) References Cited

U.S. PATENT DOCUMENTS

2013/0114106 A1* 5/2013 Sato ..... G06K 15/1822
358/1.15
2016/0065753 A1* 3/2016 Tachibana ..... G06F 3/121
358/1.14

* cited by examiner

PRINTING SYSTEM, METHOD OF CONTROLLING THE SAME, AND STORAGE MEDIUM

BACKGROUND OF THE INVENTION

Field of the Invention

The present invention relates to a printing system that performs imposition for printing for a print job instructed to do particular two fold bookbinding, a method of controlling the same, and a storage medium.

Description of the Related Art

A printing system conventionally has functions of executing various kinds of processing for a print job. For example, Japanese Patent Laid-Open No. 2012-000773 proposes a bookbinding imposition function of imposing submitted print data to each print sheet according to a consistent page order upon bookbinding in RIP processing of a printing system so as to bind a print product as a final product. Bookbinding imposition means imposing all pages of submitted print data as sets of two pages and generating a series of print data for the front and back surfaces of print sheets from the imposed print data. A printing apparatus prints the series of print data on both surfaces of print sheets in the same top/bottom orientation, and the bundle of printed print sheets is bound at the center by stapling or the like. Then, the bundle is two-folded to complete bookbinding.

However, this conventional technique has problems to be described below. For example, there are various styles of bookbinding, and one is particular two fold bookbinding. For this bookbinding style, any other conventional bookbinding format cannot be applied because of its features. Particular two fold bookbinding is one of bookbinding styles for two-folding all printed print sheets and bonding one outer surface of a two-folded print sheet to one outer surface of another two-folded print sheet by glue such that one spread is formed by turning a page. This bookbinding is also called glue back binding or simply two folding. The particular two fold bookbinding ensures easy browsing of a spread and is often used to print, for example, a CAD drawing or a construction drawing. In addition, since print sheets are bonded to each other, the thickness and strength of pages after bonding increase. Hence, the method is also used to make, for example, a picture book for children.

When the conventional bookbinding imposition technique is used in the particular two fold bookbinding, all pages of submitted print data are imposed as sets of two pages, and print data of four pages are imposed in total to the front and back surfaces of one print sheet. Hence, if the outer surfaces of two adjacent two-folded print sheets are bonded by glue when performing particular two fold bookbinding, the printed surfaces of the two bonded pages are invisibly hidden. Hence, this method is inappropriate as bookbinding of a final product.

To avoid this, it is necessary to correctly grasp the number of pages of print data, an imposition logic unique to the bookbinding, and a paper conveyance operation and a printing operation unique to the printing apparatus and create print data at the time of job data generation. However, since creation of such print data is complex and time-consuming, the printing system is difficult to use, and the print productivity is low.

SUMMARY OF THE INVENTION

The present invention enables realization of a mechanism that, in a case in which imposition processing for particular two fold bookbinding is executed, sets the particular two fold bookbinding without awareness of the number of pages of print data, an imposition logic unique to the particular two fold bookbinding, and a paper conveyance operation and a printing operation unique to a printing apparatus at the time of job data creation, like another bookbinding format.

One aspect of the present invention provides a printing system comprising: an obtaining unit configured to obtain a print job; an analysis unit configured to analyze the print job obtained by the obtaining unit; and an imposition unit configured to impose print pages to a total of four surfaces of a print target sheet including two surfaces on each of front and back in accordance with a bookbinding format designated in the print job analyzed by the analysis unit, wherein if the bookbinding format is particular two fold bookbinding for which processing of two-folding a sheet and bonding a plurality of two-folded sheets is performed, the imposition unit performs imposition while reserving a glue surface not to print out of the four surfaces of the print target sheet.

Another aspect of the present invention provides a method of controlling a printing system, comprising: obtaining a print job; analyzing the print job obtained in the obtaining; and imposing print pages to a total of four surfaces of a print target sheet including two surfaces on each of front and back in accordance with a bookbinding format designated in the print job analyzed in the analyzing, wherein in the imposing, if the bookbinding format is particular two fold bookbinding for which processing of two-folding a sheet and bonding a plurality of two-folded sheets is performed, imposition is performed while reserving a glue surface not to print out of the four surfaces of the print target sheet.

Still another aspect of the present invention provides a non-transitory computer-readable storage medium storing a computer program that causes a computer to execute steps of a control method of an apparatus, the control method comprising: obtaining a print job; analyzing the print job obtained in the obtaining; and imposing print pages to a total of four surfaces of a print target sheet including two surfaces on each of front and back in accordance with a bookbinding format designated in the print job analyzed in the analyzing, wherein in the imposing, if the bookbinding format is particular two fold bookbinding for which processing of two-folding a sheet and bonding a plurality of two-folded sheets is performed, imposition is performed while reserving a glue surface not to print out of the four surfaces of the print target sheet.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

<Arrangement of Printing Apparatus>

Figure 1:
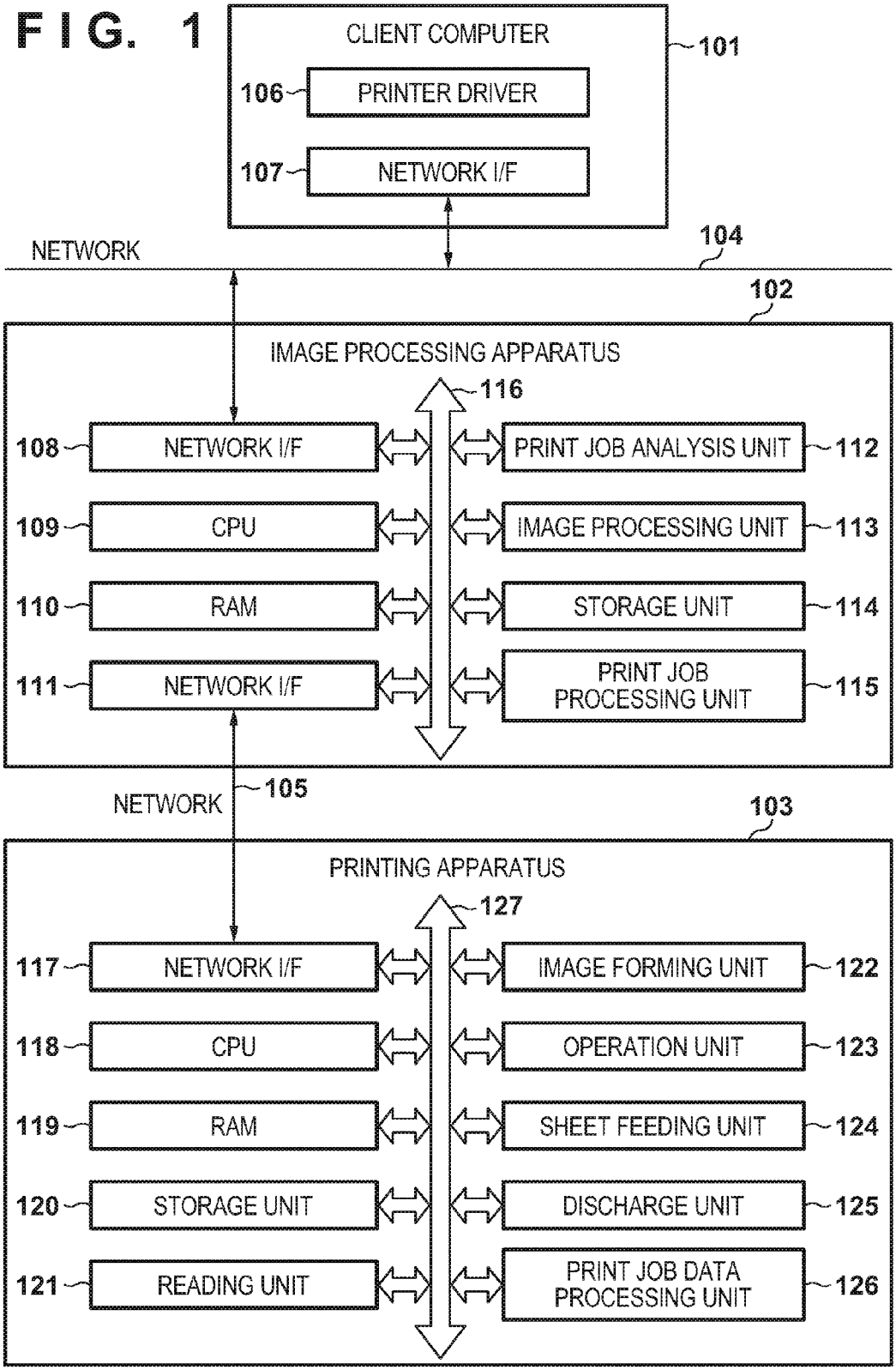
FIG. 1 is a block diagram showing the overall arrangement of a printing system.

The first embodiment of the present invention will now be described in detail with reference to the accompanying drawings. The overall arrangement of a printing system including an image processing apparatus and a printing apparatus according to the first embodiment of the present invention will be described first with reference to FIG. 1. Note that either a single device or a system formed from a plurality of devices is usable as long as it executes a function such as print processing according to the present invention. The system may be connected via a network such as a LAN (Local Area Network) or WAN (Wide Area Network) to perform processing. That is, a system arrangement to be described in the following embodiment to which various kinds of terminals are connected is merely an example, and there are various arrangement examples according to the application purpose and object, as a matter of course.

The printing system includes a client computer 101, an image processing apparatus 102, a printing apparatus 103, and networks 104 and 105. The client computer 101 is an apparatus in which a printer driver 106 is installed, and is connected to the network 104 via a network I/F 107. In this embodiment, the client computer 101 will be described as an information processing apparatus. The printer driver 106 is software that operates on an OS (Operating System) configured to control the client computer 101. The printer driver 106 also expresses print data in PDL (Page Description Language) based on a print instruction from an application, and transmits it to the image processing apparatus 102 as a print job. The network I/F 107 is connected to and communicates with an external device via the network 104, and executes communication control processing on the network. The network I/F 107 can perform Internet communication using, for example, TCP/IP (Transmission Control Protocol/Internet Protocol) or data transmission/reception to/from the image processing apparatus 102. Note that the information processing apparatus generally includes, for example, a CPU (Central Processing Unit), an HDD (Hard Disk Drive), a RAM (Random Access Memory), and various kinds of input/output devices. However, these are general-purpose components, and a description thereof will be omitted in this embodiment.

The image processing apparatus 102 includes a network I/F 108, a CPU 109, a RAM 110, a network I/F 111, a print job analysis unit 112, an image processing unit 113, a storage unit 114, and a print job processing unit 115. They are connected by a system bus 116 so as to be communicable with each other. Note that in this embodiment, the image processing apparatus 102 will be described as a printer controller. The printer controller is an information processing apparatus for mainly performing image processing of receiving drawing data described in PDL, which is generated by the printer driver 106 or the like, interpreting the PDL, converting it into print image data, and outputting it to the printing apparatus 103 to be described later. Note that this information processing apparatus is generally configured by adding a hardware electronic circuit board on which an integrated circuit dedicated to image processing is mounted to a computer that is a general-purpose information processing apparatus. However, the image processing may be performed only by a software program.

The network I/F 108 is connected to and communicates with an external device via the network 104, and executes communication control processing on the network. The network I/F 108 can perform Internet communication using, for example, TCP/IP or data transmission/reception to/from the client computer 101. The CPU 109 performs various kinds of arithmetic processing, information processing, and device control by various kinds of programs stored in the storage unit 114 of the image processing apparatus 102 and loaded to the RAM 110. The RAM 110 is a kind of general volatile storage device directly accessible from the CPU 109, and is used as the work area of the CPU 109 or a temporary data storage area.

The network I/F 111 is connected to and communicates with an external device via the network 105, and executes communication control processing on the network. The network I/F 111 can perform Internet communication using, for example, TCP/IP or data transmission/reception to/from the printing apparatus 103. The print job analysis unit 112 analyzes a print job received by the network I/F 108, and obtains print image information and print attribute information. Note that print image information is drawing data described in PDL, and print attribute information is information about various kinds of print settings such as a page setting, imposition instruction, sheet feeding, and finishing instruction, and also includes information associated with the job.

The image processing unit 113 interprets PDL included in a print job, performs RIP (Raster Image Processor) processing using print image information and print attribute information, and generates print image data rasterized on a page basis. Note that PDL is a language used to describe an instruction to control a page printer, represented by, for example, PS (Post Script) or PCL (Printer Control Language). The print image data generated by the image processing unit 113 is transferred to the printing apparatus 103 via the network I/F 111 as print job data together with the print attribute information under the control of the print job processing unit 115 to be described later. The storage unit 114 has a function of temporarily or permanently spooling and storing a print job received from the client computer 101, and will be explained as an HDD in this embodiment. The print job processing unit 115 controls the entire image processing apparatus 102 and also performs control of the main processing of the image processing apparatus 102 such as processing of a print job to be described later with reference to FIG. 3.

The printing apparatus 103 includes a network I/F 117, a CPU 118, a RAM 119, a storage unit 120, a reading unit 121, an image forming unit 122, an operation unit 123, a sheet feeding unit 124, a discharge unit 125, and a print job data processing unit 126. They are connected by a system bus 127 so as to be communicable with each other. Note that in this embodiment, the printing apparatus 103 will be explained as an MFP (Multi Function Peripheral) including a copying function, a printer engine function, a FAX (Facsimile) function, and the like. The network I/F 117 is connected to and communicates with an external device via the network 105, and executes communication control processing on the network. The network I/F 117 can perform Internet communication using, for example, TCP/IP or data transmission/reception to/from the image processing apparatus 102.

The CPU 118 performs various kinds of arithmetic processing, information processing, and device control by various kinds of programs stored in the storage unit 120 of the printing apparatus 103 and loaded to the RAM 119. The RAM 119 is a kind of general volatile storage device directly accessible from the CPU 118, and is used as the work area of the CPU 118 or a temporary data storage area. The storage unit 121 has a function of temporarily or permanently spooling and storing print job data received from the image processing apparatus 102, and will be explained as an HDD in this embodiment.

The reading unit 121 reads a paper document by an optical method, and will be explained as a scanner in this embodiment. The scanner includes a document illumination lamp and a scanning mirror, and is configured to optically scan a document placed on a platen glass. Light reflected by the document is guided to a lens by the scanning mirror and a reflecting mirror. The optical signal transmitted through the lens is guided to a solid-state image sensor. The optical signal is converted into an electrical signal by the solid-state image sensor and recognized as an image signal. Note that the solid-state image sensor indicates, for example, a CCD (Charge Coupled Device) or CMOS (Complementary Metal Oxide Semiconductor) image sensor.

The CPU 118 functions as an authentication unit, and determines using authentication information included in print job data received by the network I/F 117 whether to perform print processing of the print job data. That is, under the control of the print job data processing unit 126 to be described later, only when authentication information set for the printing apparatus 103 matches that included in the print job data, print processing is continued. On the other hand, if they do not match, print processing is stopped.

The image forming unit 122 is a print process of forming an image using raster data that is print image data generated by the image processing apparatus 102 and included in print job data, and will be explained as a printer engine in this embodiment. That is, the image forming unit 122 forms an image on a print sheet based on raster data generated by the image processing unit 113 by RIP processing to obtain a print product. Note that in this embodiment, image formation is done by electrophotography using toner. However, another means using, for example, ink in place of toner may be used.

The operation unit 123 is a user interface configured to operate or set the printing system, and will be explained as a device using an LCD (Liquid Crystal Display) touch panel in this embodiment. The sheet feeding unit 124 stores print sheets used in the MFP, and is generally called a sheet cassette, sheet drawer, or sheet deck. In general, a plurality of sheet cassettes are provided. Which one of the plurality of sheet cassettes feeds print sheets changes depending on the attribute of print job data concerning the print sheet or sheet cassette or the settings and state of the MFP, and is decided by the print job data processing unit 126 to be described later.

A fed print sheet is conveyed to the image forming unit 122 and undergoes image formation to form a print product. According to the attribute of the print job data, the discharge unit 125 performs post processing for the print product with the image formed by the image forming unit 122, and discharges it to the outside of the printing apparatus 103, and will be explained as a finisher in this embodiment. The discharge unit 125 represented by a finisher or a stacker generally has post processing functions such as a stapling function, a punching function, a folding function such as two folding, and a saddle stitching function. The discharge unit 125 also has several discharge destinations such as a stack tray. The post processing functions and the discharge destination are determined in accordance with the attribute of print job data. The instruction, post processing control, and discharge control are performed by the print job data processing unit 126 to be described later. The print job data processing unit 126 controls the entire printing apparatus 103 and processing of print job data, and will be explained as an MFP controller in this embodiment.

The network 104 is a global or local network represented by the Internet or LAN, and serves as a medium that connects the client computer 101 and the image processing apparatus 102. A network communication technology represented by TCP/IP is used for the connection. The network 105 is a global or local network represented by the Internet or LAN, and serves as a medium that connects the image processing apparatus 102 and the printing apparatus 103. A network communication technology represented by TCP/IP is used for the connection. Note that in this embodiment, connection and the communication method between the network I/F 111 and the network I/F 117 will be explained as peer to peer.

The print job processing unit 115 and the image processing unit 113 according to this embodiment will be described in more detail. The print job processing unit 115 not only controls the entire image processing apparatus 102 and print job processing but also determines based on print attribute information obtained by the print job analysis unit 112 whether the received print job is instructed to do imposition for particular two fold bookbinding. Upon determining that the print job is instructed to do imposition for particular two fold bookbinding, the print job processing unit 115 instructs the image processing unit 113 to generate print image data by imposition for particular two fold bookbinding. The image processing unit 113 divides each print sheet of the print target into a total of four surfaces, that is, two, left and right surfaces on each of the front and back surfaces, and imposes three pages at maximum to a total of three surfaces of a first sheet that is the first print sheet in particular two fold bookbinding. In addition, for an intermediate sheet as an intermediate print sheet, two pages are imposed at maximum to a total of two surfaces. For a final sheet as the last print sheet, three pages are imposed at maximum to a total of three surfaces. However, out of the total of four surfaces in any of the first sheet, the intermediate sheet, and the final sheet, page imposition is not performed for each surface to be glued at the time of particular two fold bookbinding, and the print image data is generated such that the print product can have pages in a proper order. Details of control will be described later.

In this embodiment, the networks 104 and 105 are independent network arrangements. However, one network arrangement including the client computer 101, the image processing apparatus 102, and the printing apparatus 103 may be formed. In this embodiment, the image processing apparatus 102 and the printing apparatus 103 are independent apparatus arrangements. However, one apparatus arrangement having the functions of the respective apparatuses, that is, one apparatus arrangement containing the means of all apparatuses may be formed.

<Arrangement of Printing Apparatus>

Figure 2:
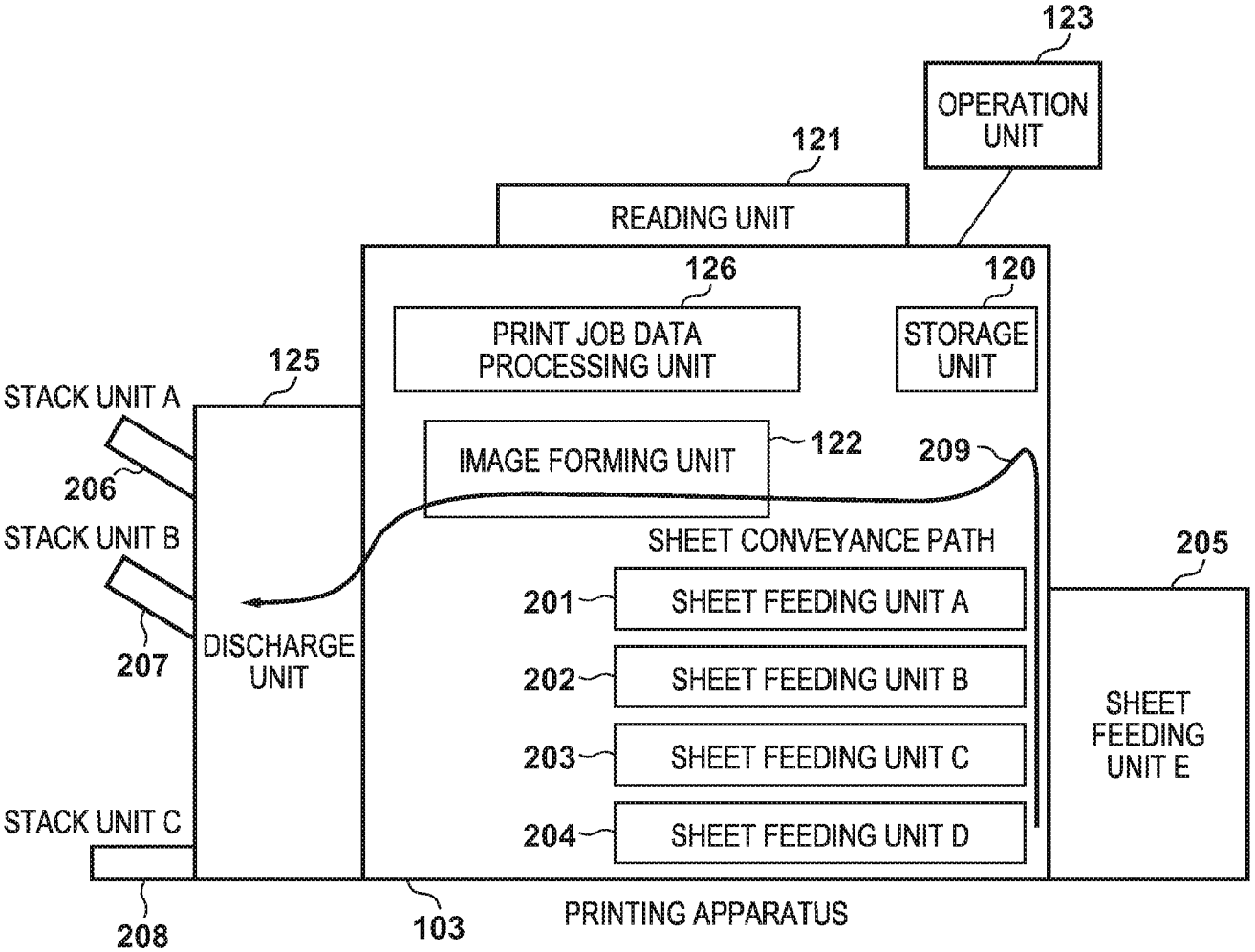
FIG. 2 is a view showing the arrangement of a printing apparatus.

An example of the arrangement of the printing apparatus according to this embodiment will be described next with reference to FIG. 2. As described above, the printing apparatus 103 includes the storage unit 120, the reading unit 121, the print job data processing unit 126, the image forming unit 122, the operation unit 123, the sheet feeding unit 124, and the discharge unit 125. Note that a description of the components explained with reference to FIG. 1 will be omitted.

The sheet feeding unit 124 is formed from a plurality of sheet cassettes or sheet decks for sheet feeding, including a sheet feeding unit A 201, a sheet feeding unit B 202, a sheet feeding unit C 203, a sheet feeding unit D 204, and a sheet feeding unit E 205. The discharge unit 125 is formed from a plurality of stack trays for discharge, including a stack unit A 206, a stack unit B 207, and a stack unit C 208. In particular, a print product that has undergone post processing by two folding or saddle stitching is conveyed to a dedicated stack unit such as the stack unit C 208. A sheet conveyance path 209 shown in FIG. 2 indicates a conveyance path of a print sheet that is fed from one of the sheet feeding unit A 201 to the sheet feeding unit E 205 after the start of print control by the print job data processing unit 126 and reaches one of the stack unit A 206 to the stack unit C 208 via the image forming unit 122.

<Print Job>

Figure 3:
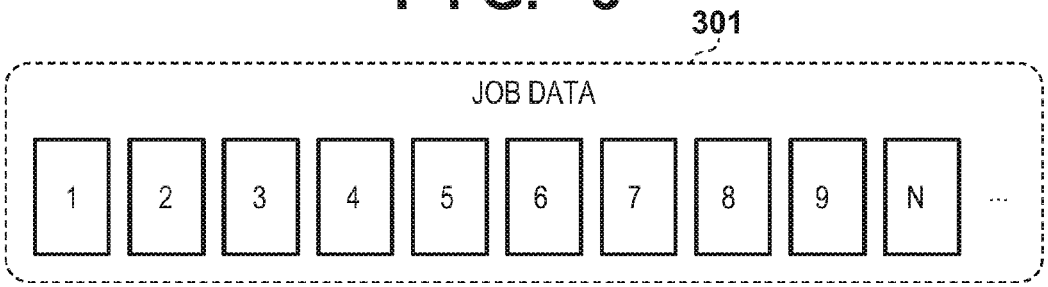
FIG. 3 is a view for explaining a print job.

A print job according to this embodiment will be described next with reference to FIG. 3. A print job that the image processing apparatus 102 receives from the client computer 101 includes one or a plurality of print pages, as shown in FIG. 3, and generally has a PDL data format. The job data 301 includes print attribute information including information about various kinds of print settings such as a page setting, imposition instruction, sheet feeding, and finishing instruction and information associated with the job in addition to print image information that is drawing data of each page.

More specifically, the job data 301 is received by the network I/F 108 of the image processing apparatus 102 via the network I/F 107 of the client computer 101 and the network 104. Each of the above-described pieces of information of the received job data 301 is analyzed by the print job analysis unit 112.

<Imposition>

Figure 4:
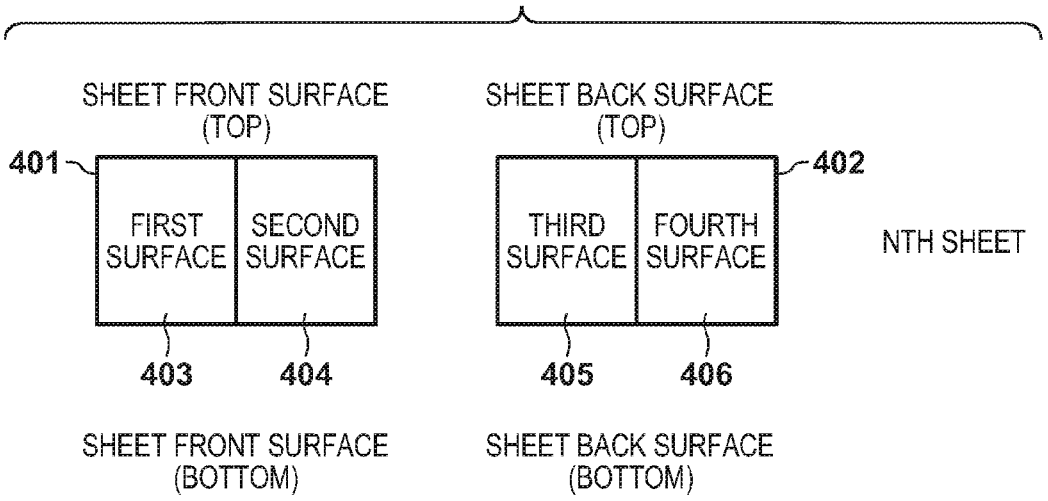
FIG. 4 is a view for explaining imposition.

Imposition according to this embodiment will be described next with reference to FIG. 4. As described above with reference to FIG. 3, the job data 301 includes print attribute information including information about various kinds of print settings such as a page setting, imposition instruction, sheet feeding, and finishing instruction and information associated with the job in addition to print image information that is drawing data of each print page. Concerning the imposition instruction, for example, if a bookbinding format such as saddle stitching, two fold bookbinding, or particular two fold bookbinding is instructed, as shown in FIG. 4, each print sheet is distinguished into a sheet front surface 401 and a sheet back surface 402 for convenience's sake. For example, the sheet front surface 401 is distinguished into a first surface 403 and a second surface 404 so that a print page can be laid out on each surface. The sheet back surface 402 is distinguished into a third surface 405 and a fourth surface 406 so that a print page can be laid out on each surface.

Note that in this embodiment, each print sheet is distinguished into the front surface and the back surface. Either surface of the print sheet can be the front surface or the back surface. One of the surfaces is distinguished as the front surface, and the other is distinguished as the back surface for convenience's sake. Each of the sheet front surface 401 and the sheet back surface 402 has print pages laid out on two, left and right surfaces. However, each surface may be divided into more surfaces to enable layout of more print pages, that is, imposition of more print pages. On the other hand, the sheet front surface 401 or the sheet back surface 402 need not always be distinguished into a plurality of surfaces and, depending on a sheet, a single page may be laid out on one surface, that is, on an entire print sheet surface. At any rate, layout can be done flexibly in accordance with the print job.

<Saddle Stitching>

Figure 5:
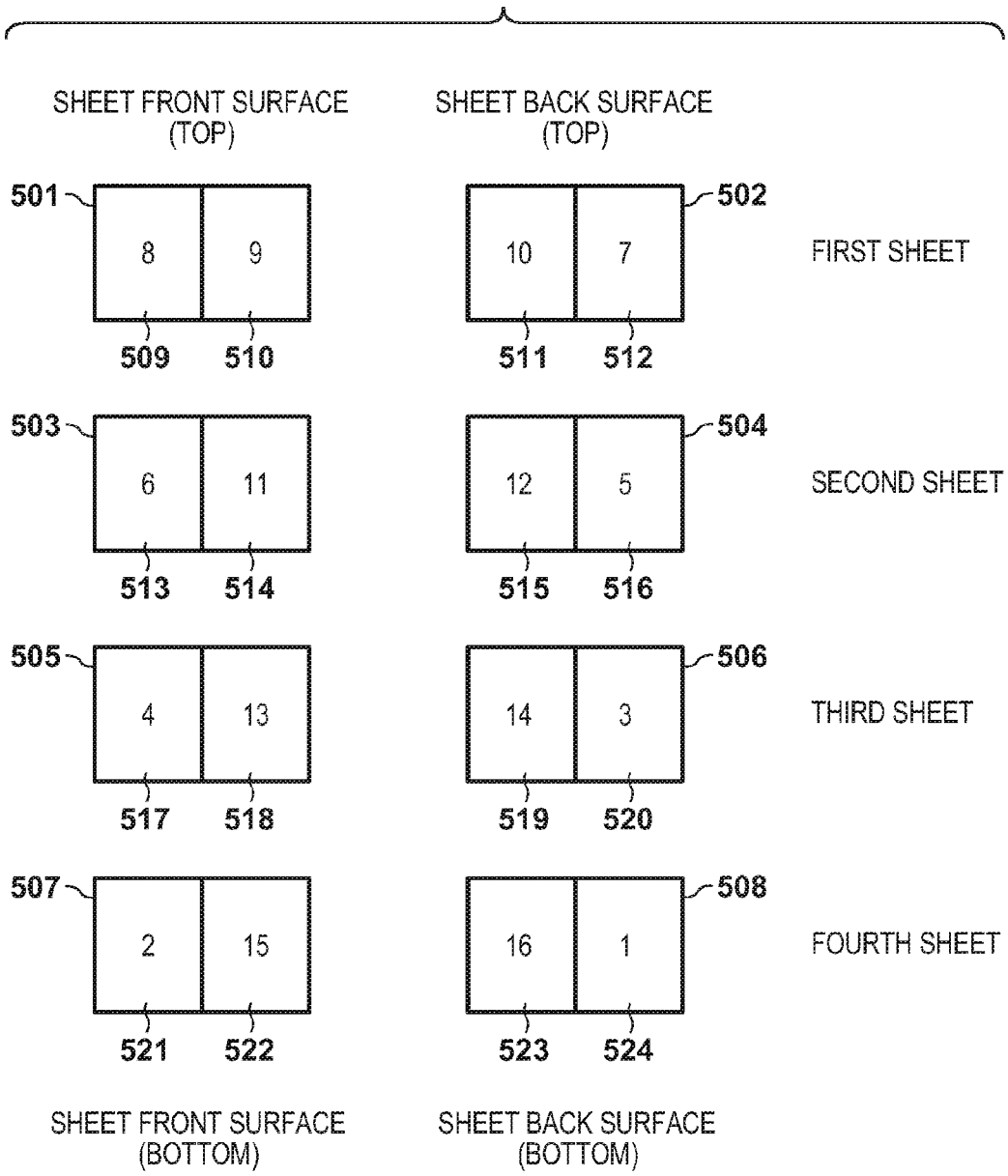
FIG. 5 is a view for explaining imposition of saddle stitching.

Saddle stitching will be described next with reference to FIGS. 5 and 6 as a comparison example to the present invention. Imposition of saddle stitching will be described with reference to FIG. 5.

Assume that out of the print attribute information of a print job, an imposition instruction instructs saddle stitching for job data including, for example, a total of 16 pages. In this case, each print sheet is distinguished into a sheet front surface and a sheet back surface for convenience's sake, as described with reference to FIG. 4. That is, as shown in FIG. 5, the print sheets are distinguished into a first sheet front surface 501, a first sheet back surface 502, a second sheet front surface 503, a second sheet back surface 504, a third sheet front surface 505, a third sheet back surface 506, a fourth sheet front surface 507, and a fourth sheet back surface 508. Note that in this embodiment, the job data includes a total of 16 pages. However, any number of pages that can be handled by the printing system can be set.

Next, as described with reference to FIG. 4, each print sheet is distinguished such that print pages can be laid out on two, left and right surfaces of each of the front surface and the back surface of the print sheet. That is, as shown in FIG. 5, the first sheet front surface 501 is distinguished into a first sheet first surface 509 on the left side of the front surface and a first sheet second surface 510 on the right side of the front surface, and the first sheet back surface 502 is distinguished into a first sheet third surface 511 on the left side of the back surface and a first sheet fourth surface 512 on the right side of the back surface. The second sheet front surface 503 is distinguished into a second sheet first surface 513 and a second sheet second surface 514, and the second sheet back surface 504 is distinguished into a second sheet third surface 515 and a second sheet fourth surface 516. The third sheet front surface 505 is distinguished into a third sheet first surface 517 and a third sheet second surface 518, and the third sheet back surface 506 is distinguished into a third sheet third surface 519 and a third sheet fourth surface 520. The fourth sheet front surface 507 is distinguished into a fourth sheet first surface 521 and a fourth sheet second surface 522, and the fourth sheet back surface 508 is distinguished into a fourth sheet third surface 523 and a fourth sheet fourth surface 524.

Next, the total of 16 pages of the job data are laid out on the surfaces of the sheets in accordance with the style of saddle stitching. In the style of saddle stitching, two pages are printed on each surface of a print sheet in the same top/bottom orientation, and the bundle of printed print sheets is bound at the center by stapling or the like. Then, the bundle is two-folded to complete bookbinding. More specifically, as shown in FIG. 5, the eighth page is laid out on the first sheet first surface 509, the ninth page is laid out on the first sheet second surface 510, the 10th page is laid out on the first sheet third surface 511, and the seventh page is laid out on the first sheet fourth surface 512. The sixth page is laid out on the second sheet first surface 513, the 11th page is laid out on the second sheet second surface 514, the 12th page is laid out on the second sheet third surface 515, and the fifth page is laid out on the second sheet fourth surface 516. The fourth page is laid out on the third sheet first surface 517, the 13th page is laid out on the third sheet second surface 518, the 14th page is laid out on the third sheet third surface 519, and the third page is laid out on the third sheet fourth surface 520. The second page is laid out on the fourth sheet first surface 521, the 15th page is laid out on the fourth sheet second surface 522, the 16th page is laid out on the fourth sheet third surface 523, and the first page is laid out on the fourth sheet fourth surface 524.

Figure 6:
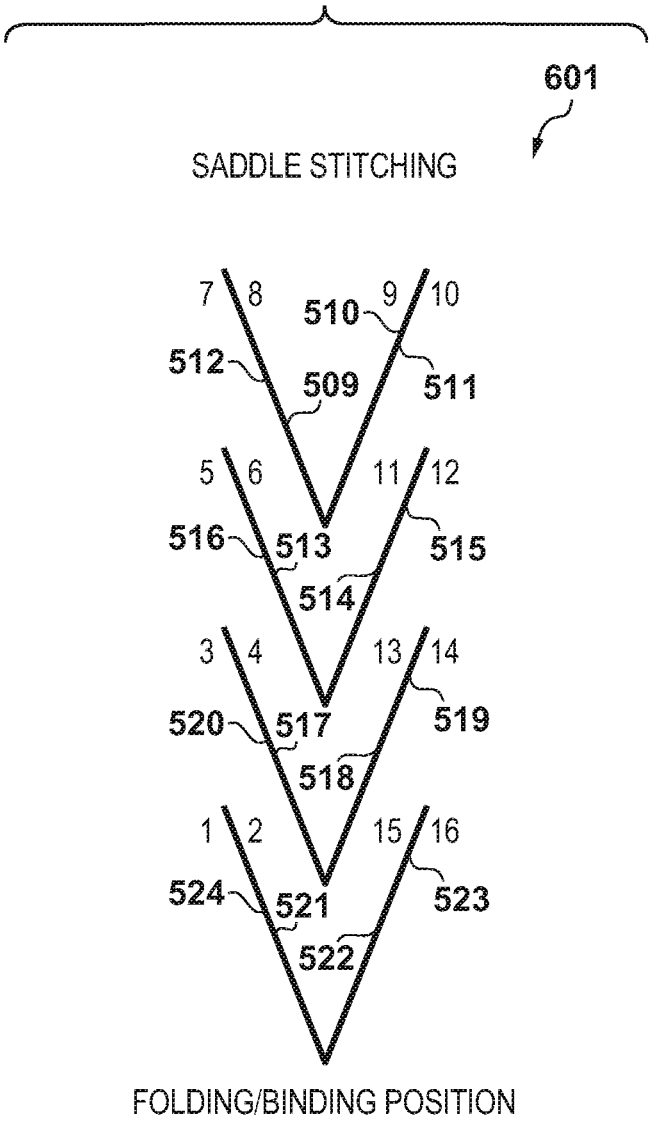
FIG. 6 is a view for explaining saddle stitching.

In imposition of saddle stitching, the image processing unit 113 lays out each print page on one of the surfaces of the first to fourth sheets, as shown in FIG. 6. After that, the image forming unit 122 forms images on both surfaces of each sheet in the order from the fourth sheet to the first sheet. The print sheets are conveyed in the printing apparatus 103 in accordance with the sheet conveyance path 209 and discharged to the discharge unit 125. The bundle of print products stacked with the sheet front surfaces facing up in the order from the fourth sheet to the first sheet is bound by stapling manually or using a device such as a finisher. Then, the bundle is two-folded, thereby completing saddle stitching 601 as a final product whose pages are turned from the left side. The print page layout method of the image processing unit 113, the image forming order of the image forming unit 122, and the stack order or stack surface of the print products to the discharge unit 125 are not limited to those of the embodiment, and can be changed as long as the saddle stitching as the final product has a consistent page order.

<Two Fold Bookbinding>

Figure 7:
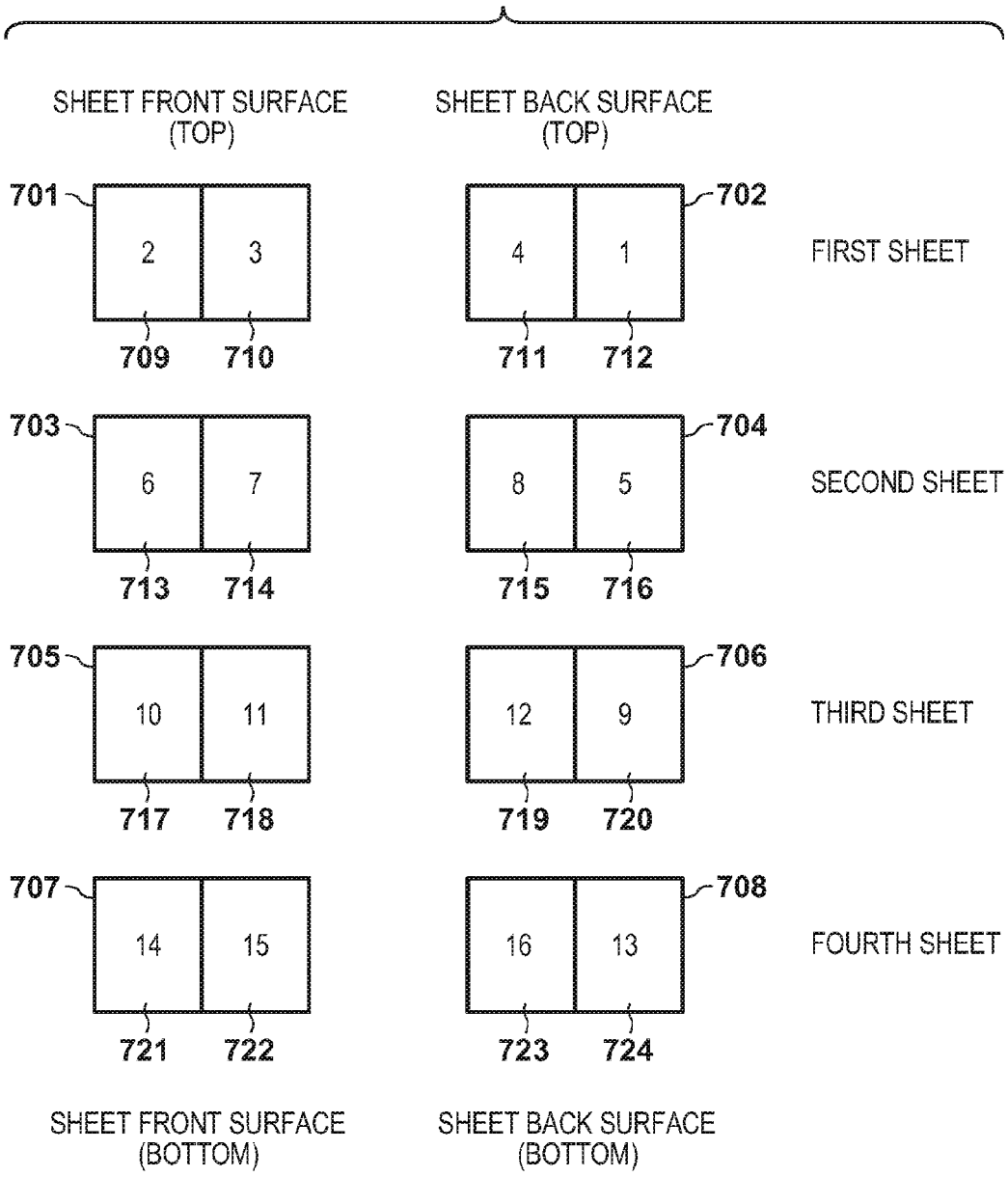
FIG. 7 is a view for explaining imposition of two fold bookbinding.

Two fold bookbinding will be described next with reference to FIGS. 7 and 8 as a comparison example to the present invention. Imposition of two fold bookbinding will be described with reference to FIG. 7.

Assume that out of the print attribute information of a print job, an imposition instruction instructs two fold bookbinding for job data including, for example, a total of 16 pages. In this case, each print sheet is distinguished into a sheet front surface and a sheet back surface for convenience's sake, as described with reference to FIG. 4. That is, as shown in FIG. 7, the print sheets are distinguished into a first sheet front surface 701, a first sheet back surface 702, a second sheet front surface 703, a second sheet back surface 704, a third sheet front surface 705, a third sheet back surface 706, a fourth sheet front surface 707, and a fourth sheet back surface 708. Note that in this embodiment, the job data includes a total of 16 pages. However, any number of pages that can be handled by the printing system can be set.

Next, as described with reference to FIG. 4, each print sheet is distinguished such that print pages can be laid out on two, left and right surfaces of each of the front surface and the back surface of the print sheet. That is, as shown in FIG. 7, the first sheet front surface 701 is distinguished into a first sheet first surface 709 and a first sheet second surface 710, and the first sheet back surface 702 is distinguished into a first sheet third surface 711 and a first sheet fourth surface 712. The second sheet front surface 703 is distinguished into a second sheet first surface 713 and a second sheet second surface 714, and the second sheet back surface 704 is distinguished into a second sheet third surface 715 and a second sheet fourth surface 716. The third sheet front surface 705 is distinguished into a third sheet first surface 717 and a third sheet second surface 718, and the third sheet back surface 706 is distinguished into a third sheet third surface 719 and a third sheet fourth surface 720. The fourth sheet front surface 707 is distinguished into a fourth sheet first surface 721 and a fourth sheet second surface 722, and the fourth sheet back surface 708 is distinguished into a fourth sheet third surface 723 and a fourth sheet fourth surface 724.

Next, the total of 16 pages of the job data are laid out on the surfaces of the sheets in accordance with the style of two fold bookbinding. In the style of two fold bookbinding, two pages are printed on each surface of a print sheet in the same top/bottom orientation, each printed print sheet is two-folded, and the plurality of two-folded sheets are overlaid and bound at the back (folds) by gluing or stapling, thereby completing bookbinding. More specifically, as shown in FIG. 7, the second page is laid out on the first sheet first surface 709, the third page is laid out on the first sheet second surface 710, the fourth page is laid out on the first sheet third surface 711, and the first page is laid out on the first sheet fourth surface 712. The sixth page is laid out on the second sheet first surface 713, the seventh page is laid out on the second sheet second surface 714, the eighth page is laid out on the second sheet third surface 715, and the fifth page is laid out on the second sheet fourth surface 716. The 10th page is laid out on the third sheet first surface 717, the 11th page is laid out on the third sheet second surface 718, the 12th page is laid out on the third sheet third surface 719, and the ninth page is laid out on the third sheet fourth surface 720. The 14th page is laid out on the fourth sheet first surface 721, the 15th page is laid out on the fourth sheet second surface 722, the 16th page is laid out on the fourth sheet third surface 723, and the 13th page is laid out on the fourth sheet fourth surface 724.

Figure 8:
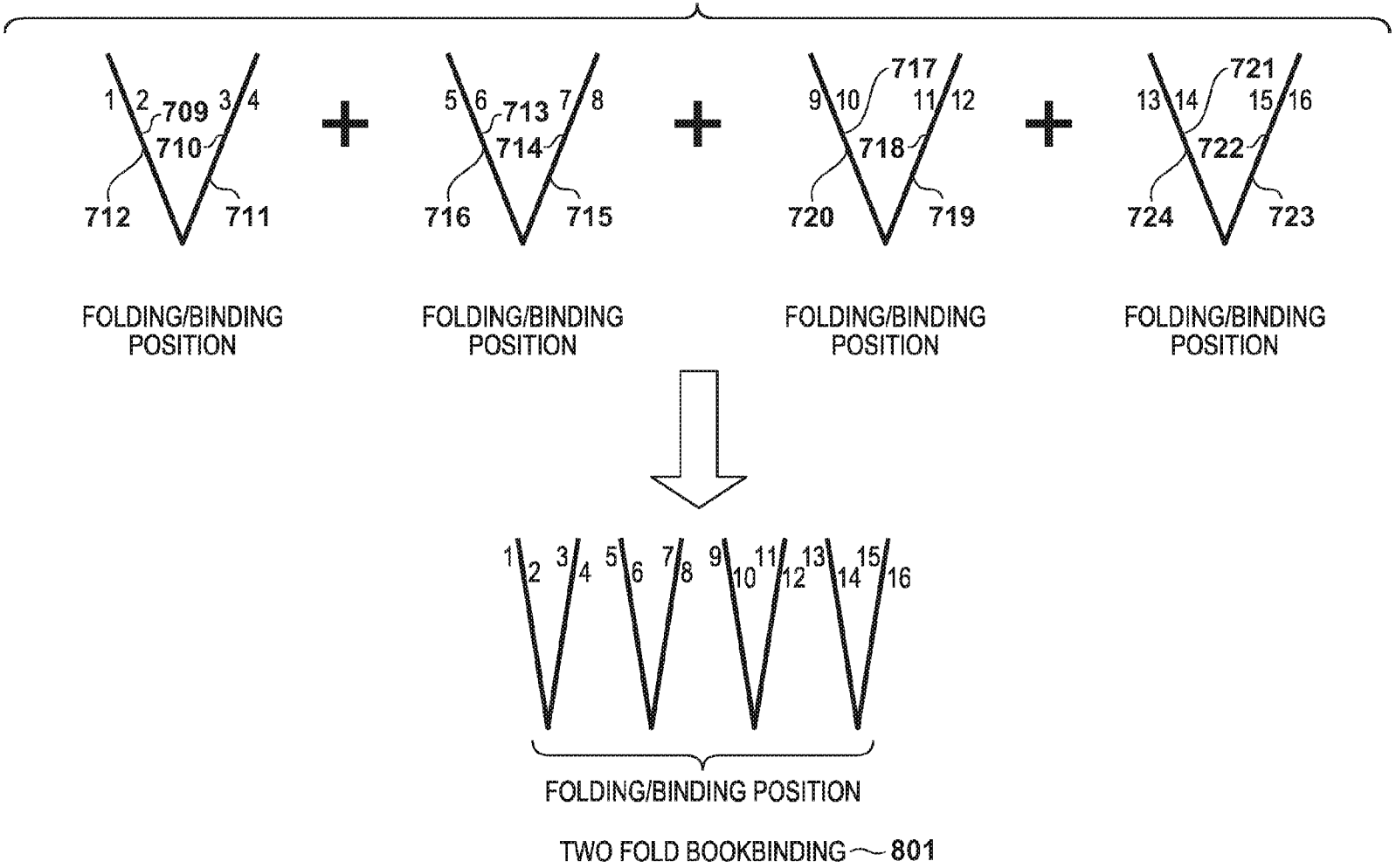
FIG. 8 is a view for explaining two fold bookbinding.

In imposition of two fold bookbinding, the image processing unit 113 lays out each page on one of the surfaces of the first to fourth sheets, as shown in FIG. 8. After that, the image forming unit 122 forms images on both surfaces in the order from the first sheet to the fourth sheet. The print sheets are conveyed in the printing apparatus 103 in accordance with the sheet conveyance path 209 and discharged to the discharge unit 125. The sheets of print products stacked with the sheet front surfaces facing up in the order from the first sheet to the fourth sheet are two-folded to make a valley fold manually or using a device such as a finisher, and the plurality of two-folded sheets are overlaid and bound at the back by gluing or stapling. Two fold bookbinding 801 as a final product whose pages are turned from the left side is thus completed. The print page layout method of the image processing unit 113, the image forming order of the image forming unit 122, and the stack order or stack surface of the print products to the discharge unit 125 are not limited to those of the embodiment, and can be changed as long as the two fold bookbinding as the final product has a consistent page order.

<Particular Two Fold Bookbinding>

Figure 9:
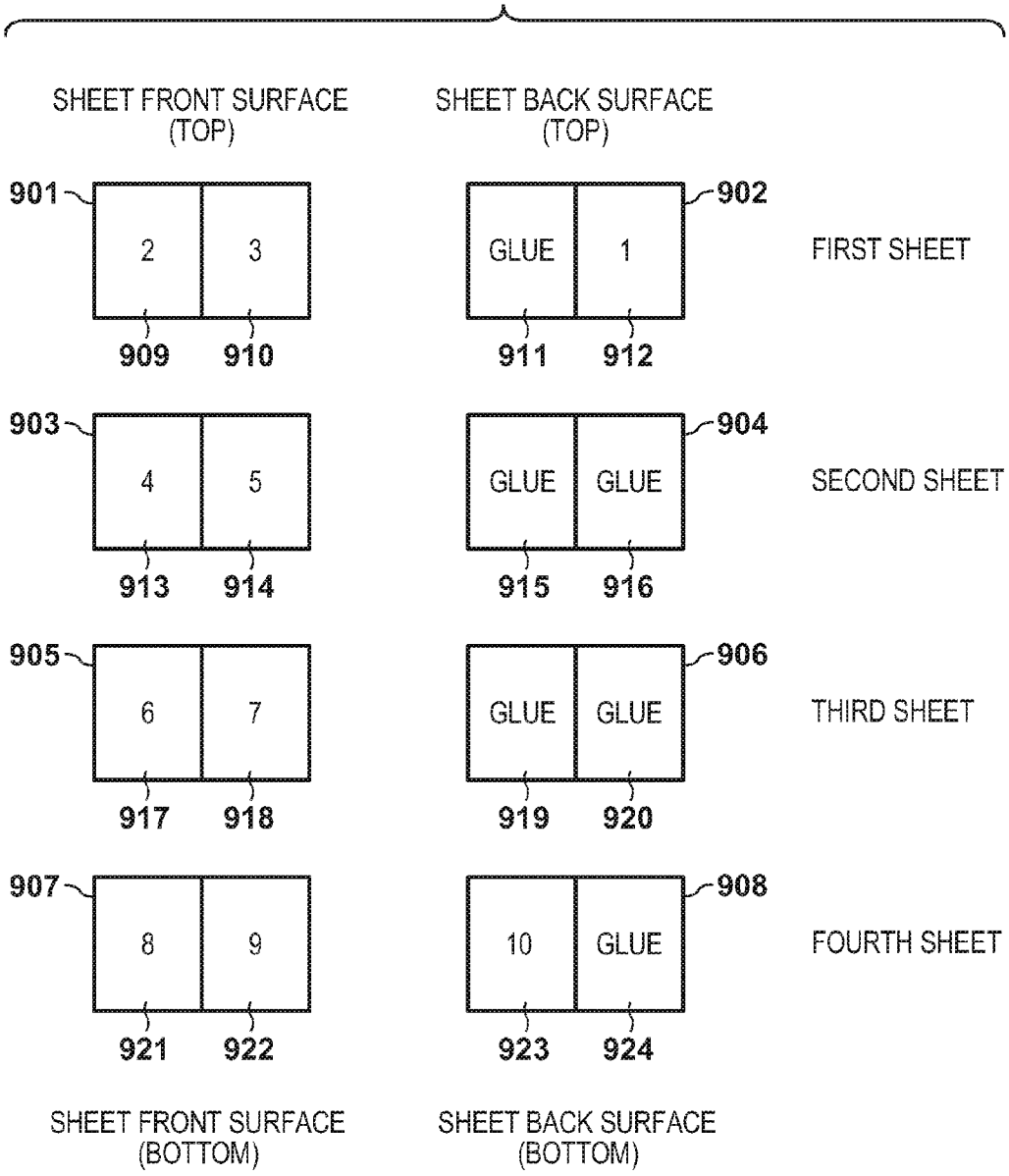
FIG. 9 is a view for explaining imposition of particular two fold bookbinding.

Particular two fold bookbinding according to the first embodiment of the present invention will be described next with reference to FIGS. 9 and 10. Imposition of particular two fold bookbinding will be described with reference to FIG. 9.

Assume that out of the print attribute information of a print job, an imposition instruction instructs particular two fold bookbinding for job data including, for example, a total of 10 pages. In this case, each print sheet is distinguished into a sheet front surface and a sheet back surface for convenience's sake, as described with reference to FIG. 4. That is, as shown in FIG. 9, the print sheets are distinguished into a first sheet front surface 901, a first sheet back surface 902, a second sheet front surface 903, a second sheet back surface 904, a third sheet front surface 905, a third sheet back surface 906, a fourth sheet front surface 907, and a fourth sheet back surface 908. Note that in this embodiment, the job data includes a total of 10 pages. However, any number of pages that can be handled by the printing system can be set.

Next, as described with reference to FIG. 4, each print sheet is distinguished such that print pages can be laid out on two, left and right surfaces of each of the front surface and the back surface of the print sheet. That is, as shown in FIG. 9, the first sheet front surface 901 is distinguished into a first sheet first surface 909 and a first sheet second surface 910, and the first sheet back surface 902 is distinguished into a first sheet third surface 911 and a first sheet fourth surface 912. The second sheet front surface 903 is distinguished into a second sheet first surface 913 and a second sheet second surface 914, and the second sheet back surface 904 is distinguished into a second sheet third surface 915 and a second sheet fourth surface 916. The third sheet front surface 905 is distinguished into a third sheet first surface 917 and a third sheet second surface 918, and the third sheet back surface 906 is distinguished into a third sheet third surface 919 and a third sheet fourth surface 920. The fourth sheet front surface 907 is distinguished into a fourth sheet first surface 921 and a fourth sheet second surface 922, and the fourth sheet back surface 908 is distinguished into a fourth sheet third surface 923 and a fourth sheet fourth surface 924.

Next, the total of 10 pages of the job data are laid out on the surfaces of the sheets in accordance with the style of particular two fold bookbinding. The particular two fold bookbinding is one of bookbinding styles for two-folding all printed print sheets and bonding one outer surface of a two-folded print sheet to one outer surface of another two-folded print sheet by glue such that one spread is formed by turning a page. This bookbinding is also called glue back binding or simply two folding. The particular two fold bookbinding ensures easy browsing of a spread and is often used to print, for example, a CAD drawing or a construction drawing. In addition, since print sheets are bonded to each other, the thickness and strength of pages after bonding increase. Hence, the method is also used to make, for example, a picture book for children. When the bookbinding imposition techniques described with reference to FIGS. 5 to 8 are used in the particular two fold bookbinding, all pages of submitted print data are imposed as sets of two pages, and print data of four pages are imposed in total to the front and back surfaces of one print sheet. Hence, if the outer surfaces of two adjacent two-folded print sheets are bonded by glue when performing particular two fold bookbinding, the printed surfaces of the two bonded pages are invisibly hidden. Hence, this method is inappropriate as bookbinding of a final product.

In the printing system according to this embodiment, in imposition processing for particular two fold bookbinding, control is performed not to impose a page image of print data of job data to a print sheet surface to be glued in particular two fold bookbinding. More specifically, as shown in FIG. 9, the second page is laid out on the first sheet first surface 909, the third page is laid out on the first sheet second surface 910, and the first page is laid out on the first sheet fourth surface 912. However, no page is laid out on the first sheet third surface 911 because it is glued by post processing. That is, a glue surface not to print is allocated. The fourth page is laid out on the second sheet first surface 913, and the fifth page is laid out on the second sheet second surface 914. However, no pages are laid out on the second sheet third surface 915 and the second sheet fourth surface 916 because they are glued by post processing. The sixth page is laid out on the third sheet first surface 917, and the seventh page is laid out on the third sheet second surface 918. However, no pages are laid out on the third sheet third surface 919 and the third sheet fourth surface 920 because they are glued by post processing. The eighth page is laid out on the fourth sheet first surface 921, the ninth page is laid out on the fourth sheet second surface 922, and the 10th page is laid out on the fourth sheet third surface 923. However, no page is laid out on the fourth sheet fourth surface 924 because it is glued by post processing.

Figure 10:
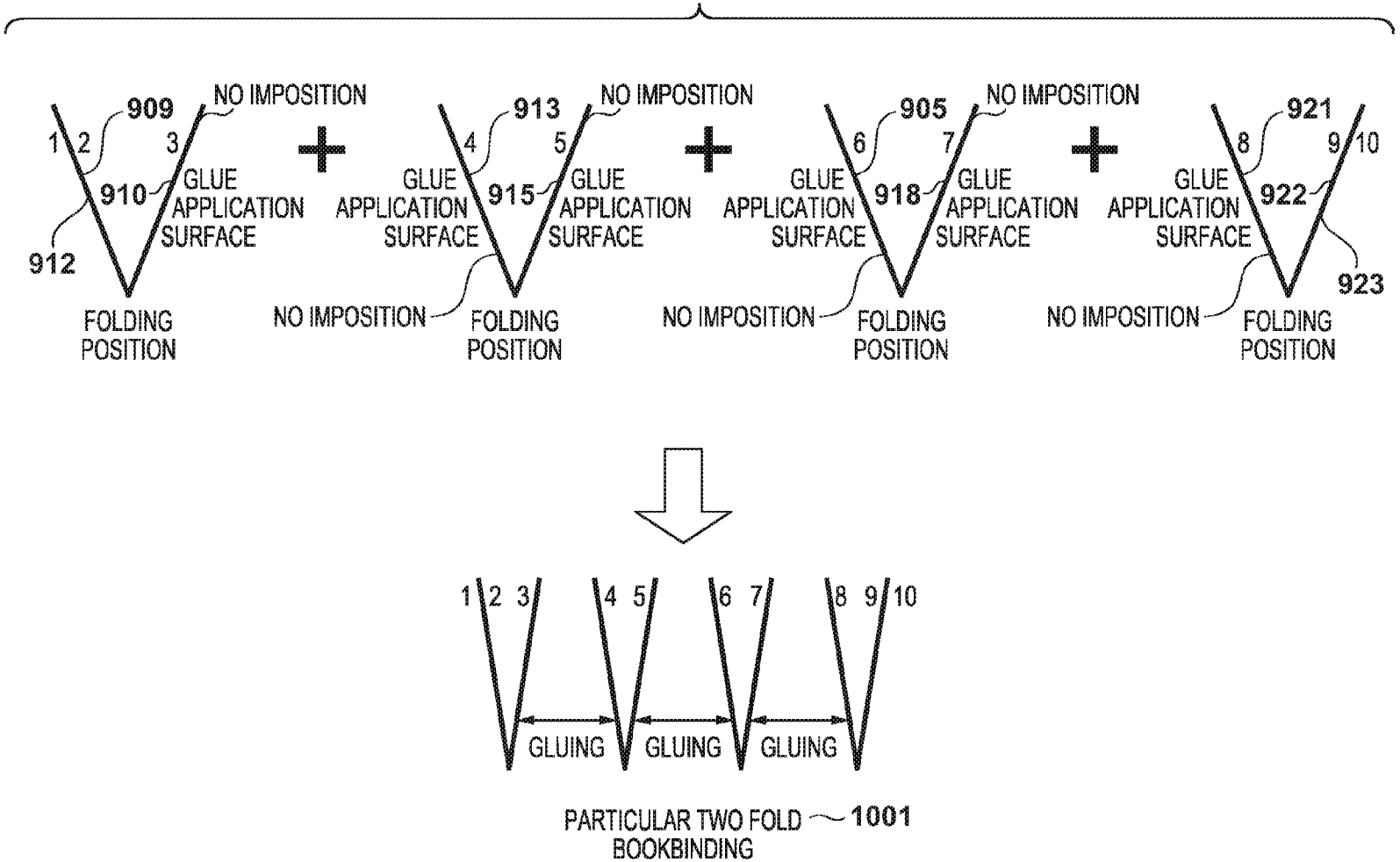
FIG. 10 is a view for explaining particular two fold bookbinding.

In imposition of particular two fold bookbinding, the image processing unit 113 lays out each page on one of the surfaces of the first to fourth sheets, as shown in FIG. 10. After that, the image forming unit 122 forms an image on one or both surfaces in the order from the first sheet to the fourth sheet. The print sheets are conveyed in the printing apparatus 103 in accordance with the sheet conveyance path 209 and conveyed to the discharge unit 125. The sheets conveyed with the sheet front surfaces facing up in the order from the first sheet to the fourth sheet are two-folded (valley-folded) by the discharge unit 125. After that, one outer surface of a two-folded sheet and one outer surface of another two-folded sheet are bonded by glue manually or using another device. Particular two fold bookbinding 1001 as a final product whose pages are turned from the left side is thus completed. The print page layout method of the image processing unit 113, the image forming order of the image forming unit 122, and the stack order or stack surface of the print products to the discharge unit 125 are not limited to those of the embodiment, and can be changed as long as the particular two fold bookbinding as the final product has a consistent page order.

<Processing Procedure>

Figure 11:
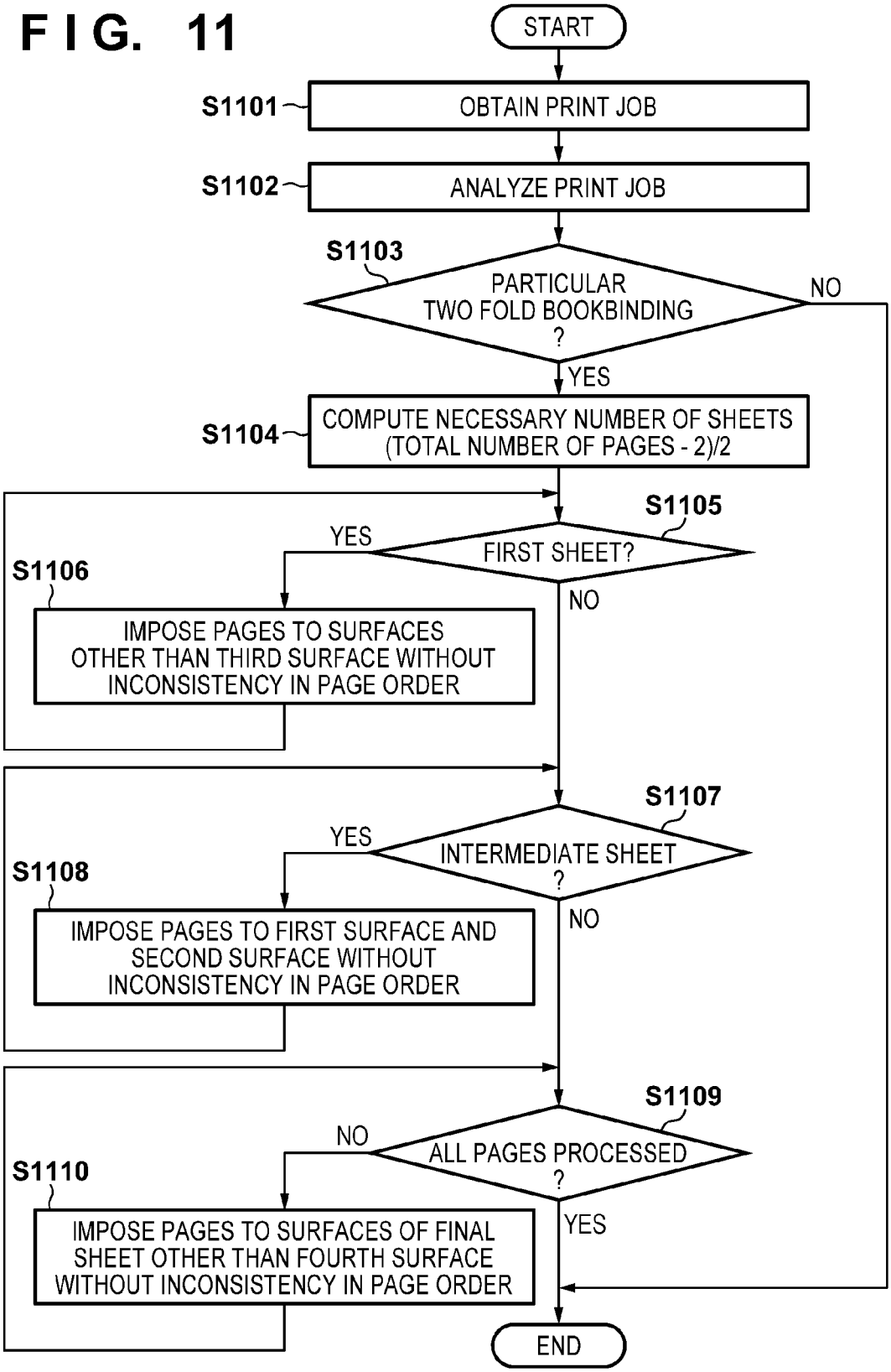
FIG. 11 is a flowchart showing a processing procedure.

Print job processing and control procedure of the printing system according to this embodiment will be described next with reference to FIG. 11. Note that as for this flowchart, in the image processing apparatus 102, the processing of the print job processing unit 115 or the image processing unit 113 is implemented when the CPU 109 executes a program stored in the storage unit 114. Additionally, in the printing apparatus 103, the processing of the print job data processing unit 126 is implemented when the CPU 118 executes a program stored in the storage unit 120.

First, in step S1101, the print job processing unit 115 obtains a print job, thereby starting processing of the printing system. The print job processing unit 115 also temporarily spools the obtained print job in the storage unit 114.

Note that a print job is job data of a PDL format sent from, for example, the client computer 101.

In step S1102, the print job processing unit 115 analyzes the print job obtained in step S1101, and obtains print image information and print attribute information. Note that print image information is drawing data described in PDL, and print attribute information is information about various kinds of print settings such as the type of a path to process a print job, a page setting, sheet feeding, job information, and finishing. Imposition instruction information as one of the print attribute information included in the print job is also obtained here.

In step S1103, the print job processing unit 115 determines whether the imposition instruction (bookbinding format) designated in the print job obtained in step S1102 is particular two fold bookbinding. If the imposition instruction is particular two fold bookbinding, the process advances to step S1104. The print job processing unit 115 instructs the image processing unit 113 to perform image processing by performing imposition of particular two fold bookbinding for the print job. Upon receiving the instruction, the image processing unit 113 computes the necessary number of sheets by an arithmetic expression "(total number of print pages−2)/2". Note that when computing the necessary number of sheets, page units need to be uniformed. For example, if the job data includes a total of six pages, and four pages include pages of two surfaces each, the number of pages is doubled, and the necessary number of sheets is computed by setting the total number of pages to 10. After that, the process advances to step S1105. On the other hand, upon determining in step S1103 that the imposition instruction is not particular two fold bookbinding, the processing of the printing system ends.

In step S1105, the image processing unit 113 determines whether the page of the image processing target is a page to be laid out on the first sheet. More specifically, in this embodiment, on the first sheet, the second page is laid out on the first sheet first surface 909, the third page is laid out on the first sheet second surface 910, and the first page is laid out on the first sheet fourth surface 912. On the other hand, no page is laid out on the first sheet third surface 911 because it is glued by post processing. That is, if the page of the image processing target is the second page, the third page, or the first page of the print job, the determination result is true. Otherwise, the determination result is false.

Upon determining in step S1105 that the page is a page to be laid out on the first sheet, the process advances to step S1106. The image processing unit 113 imposes the page of the image processing target to the first sheet, changes the page of the image processing target to the next page, and returns to step S1105. More specifically, in this embodiment, the second page is laid out on the first sheet first surface 909, the third page is laid out on the first sheet second surface 910, and the first page is laid out on the first sheet fourth surface 912 so that the particular two fold bookbinding as the final product has a consistent page order. That is, the print page is laid out (imposed) on a surface other than the third surface. On the other hand, upon determining in step S1105 that the page does not correspond to the first sheet, the process advances to step S1107.

In step S1107, the image processing unit 113 determines whether the page of the image processing target is a page to be laid out on an intermediate sheet, that is, a sheet that is neither the first sheet nor the final sheet. More specifically, in this embodiment, on the second sheet, the fourth page is laid out on the second sheet first surface 913, and the fifth page is laid out on the second sheet second surface 914. On the other hand, no pages are laid out on the second sheet third surface 915 and the second sheet fourth surface 916 because they are glued by post processing. In addition, on the third sheet, the sixth page is laid out on the third sheet first surface 917, and the seventh page is laid out on the third sheet second surface 918. However, no pages are laid out on the third sheet third surface 919 and the third sheet fourth surface 920 because they are glued by post processing. That is, if the page of the image processing target is the fourth page, the fifth page, the sixth page, or the seventh page of the print job, the determination result is true. Otherwise, the determination result is false.

Upon determining in step S1107 that the page of the image processing target is a page to be laid out on an intermediate sheet, the process advances to step S1108. The image processing unit 113 imposes the page of the image processing target to the intermediate sheet, that is, a sheet that is neither the first sheet nor the final sheet. After that, the image processing unit 113 changes the page of the image processing target to the next page, and returns to step S1107. More specifically, in this embodiment, the fourth page is laid out on the second sheet first surface 913, the fifth page is laid out on the second sheet second surface 914, the sixth page is laid out on the third sheet first surface 917, and the seventh page is laid out on the third sheet second surface 918. Each page is laid out so that the particular two fold bookbinding as the final product has a consistent page order. On the other hand, upon determining in step S1107 that the page of the image processing target is not a page to be laid out on an intermediate sheet, the process advances to step S1109.

In step S1109, the image processing unit 113 determines whether all pages of the image processing target are processed, that is, whether an all page end flag is set. In other words, the image processing unit 113 determines whether the page of the image processing target is a page to be laid out on the final sheet. More specifically, in this embodiment, on the final sheet, the eighth page is laid out on the fourth sheet first surface 921, the ninth page is laid out on the fourth sheet second surface 922, and the 10th page is laid out on the fourth sheet third surface 923. On the other hand, no page is laid out on the fourth sheet fourth surface 924 because it is glued by post processing. That is, if the page of the image processing target is the eighth page, the ninth page, or the 10th page of the print job, the determination result is false. Otherwise, in other words, if all pages of the intermediate sheet are processed, the determination result is true.

Upon determining in step S1109 that all pages are processed, the processing of the printing system ends. On the other hand, if NO in step S1109, the process advances to step S1110. The image processing unit 113 imposes the page of the image processing target to the final sheet, changes the page of the image processing target to the next page, and returns to step S1109. If the next page does not exist, that is, if the page is the final page, the all page end flag is set. More specifically, in this embodiment, the eighth page is laid out on the fourth sheet first surface 921, the ninth page is laid out on the fourth sheet second surface 922, and the 10th page is laid out on the fourth sheet third surface 923 so that the particular two fold bookbinding as the final product has a consistent page order. That is, the print page is laid out (imposed) on a surface other than the fourth surface.

As described above, the printing system according to this embodiment allows the user to omit detailed settings without awareness of the number of pages of print data, the imposition logic unique to the particular two fold bookbinding, and the paper conveyance operation and the printing operation unique to the printing apparatus at the time of job data creation. Hence, when performing particular two fold bookbinding, the printing system is easy to use, and the print productivity can be improved. More specifically, when particular two fold bookbinding is designated, the printing system according to this embodiment allows the user to omit a cumbersome operation such as designation of a print page to be glued by imposing print pages while allocating glue surfaces.

Second Embodiment

The second embodiment of the present invention will be described below in detail with reference to the accompanying drawings. Note that in this embodiment, only differences from the first embodiment will mainly be described, and a repetitive description will be omitted.

In the first embodiment, concerning a print job processed by the printing system, as described with reference to FIG. 3, the job data 301 is distinguished into the sheet front surface 401 and the sheet back surface 402 of each print sheet for convenience sake. More specifically, the sheet front surface 401 is distinguished into the first surface 403 and the second surface 404 so that a print page can be laid out on each surface. The sheet back surface 402 is distinguished into the third surface 405 and the fourth surface 406 so that a print page can be laid out on each surface. For example, all the pages of the job data have the A4 size. Two pages are laid out at maximum on the sheet front surface 401 or the sheet back surface 402 of an A3 print sheet having a twice larger size, thereby implementing particular two fold bookbinding. However, the job data may include a page in a spread state in the particular two fold bookbinding. It is not always necessary to impose a plurality of pages to the sheet front surface 401 or the sheet back surface 402.

In this embodiment, if job data includes a page in a spread state in particular two fold bookbinding, the single page is laid out on the entire sheet front surface 401 or sheet back surface 402, thereby implementing particular two fold bookbinding. In addition to the first embodiment, the printing system can thus be adapted to various print jobs and improve the convenience.

<Particular Two Fold Bookbinding>

Figure 12:
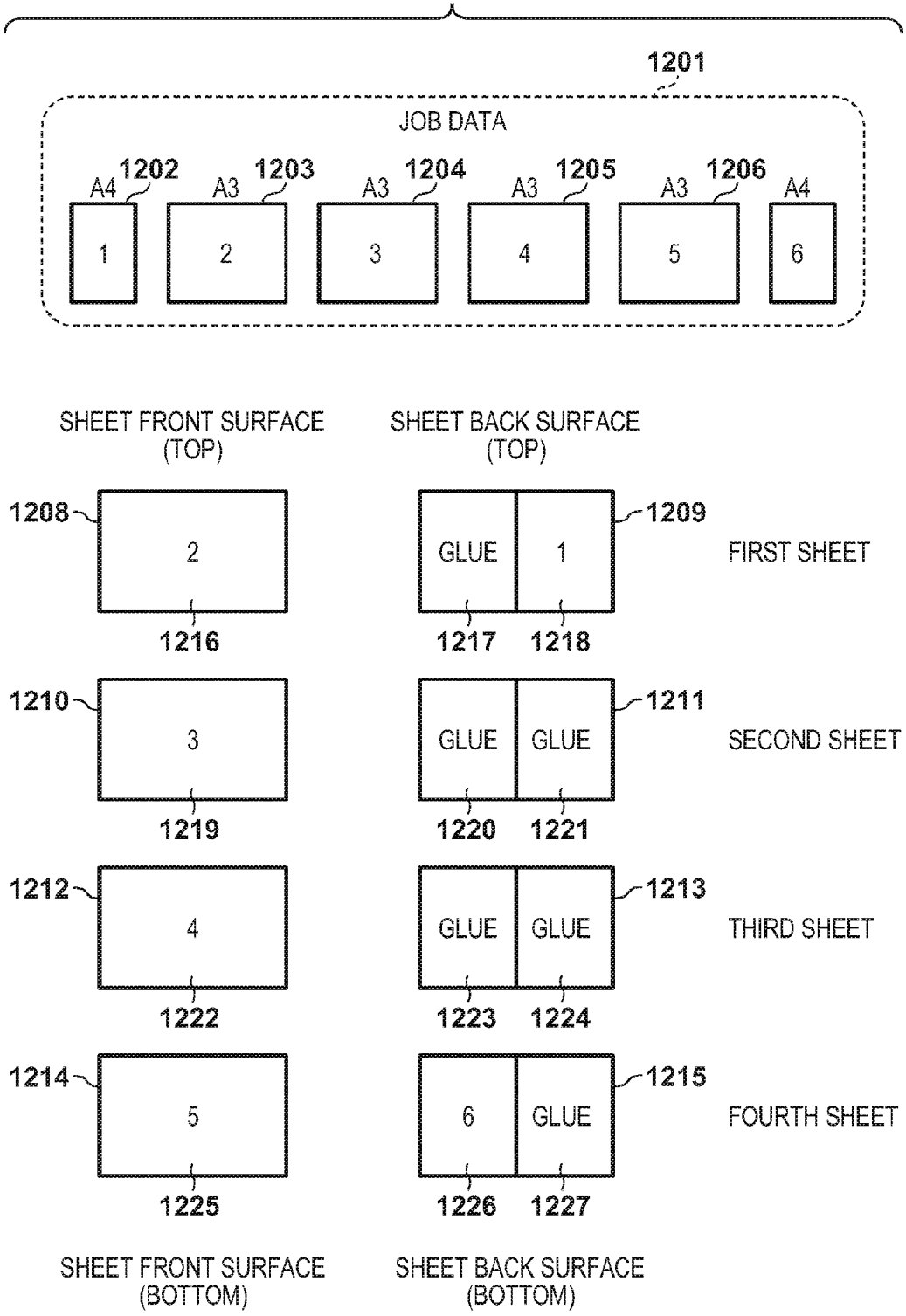
FIG. 12 is a view for explaining imposition of particular two fold bookbinding.

A print job and imposition of particular two fold bookbinding according to this embodiment will be described with reference to FIG. 12. A print job that an image processing apparatus 102 receives from a client computer 101 is also called job data 1201, includes one or a plurality of print pages, as shown in FIG. 12, and generally has a PDL data format. For example, the job data 1201 includes a first page 1202, a second page 1203, a third page 1204, a fourth page 1205, a fifth page 1206, and a sixth page 1207. The job data 1201 also includes print attribute information including information about various kinds of print settings such as a page setting, imposition instruction, sheet feeding, and finishing instruction and information associated with the job in addition to print image information that is drawing data of each page.

As shown in FIG. 12, the first page 1202 has the A4 size and serves as the front cover page in particular two fold bookbinding. Each of the second page 1203 to the fifth page 1206 has the A3 size and serves as a page in a spread state in particular two fold bookbinding. The sixth page 1207 has the A4 size and serves as the back cover page in particular two fold bookbinding. That is, each of the second page 1203 to the fifth page 1206 is a page in a spread state in particular two fold bookbinding, and needs to be laid out on the entire sheet front surface 401 or sheet back surface 402.

In a case in which out of the print attribute information of a print job, an imposition instruction instructs particular two fold bookbinding for job data including, for example, a total of six pages, each print sheet is distinguished into a sheet front surface and a sheet back surface for convenience's sake, as described with reference to FIG. 4. That is, as shown in FIG. 12, the print sheets are distinguished into a first sheet front surface 1208, a first sheet back surface 1209, a second sheet front surface 1210, a second sheet back surface 1211, a third sheet front surface 1212, a third sheet back surface 1213, a fourth sheet front surface 1214, and a fourth sheet back surface 1215. Note that in this embodiment, the job data includes a total of six pages. However, any number of pages that can be handled by the printing system can be set.

Next, as described with reference to FIG. 4, each print sheet is distinguished such that pages can be laid out on two, left and right surfaces of each of the front surface and the back surface of the print sheet. Note that each of the sheet front surface 401 and the sheet back surface 402 is distinguished into two, left and right surfaces. However, the sheet front surface 401 or the sheet back surface 402 need not always be distinguished into a plurality of surfaces and, depending on a sheet, a single page may be laid out on one surface, that is, on an entire print sheet surface. That is, as shown in FIG. 12, the first sheet front surface 1208 is distinguished into a first sheet first surface/second surface 1216, and the first sheet back surface 1209 is distinguished into a first sheet third surface 1217 and a first sheet fourth surface 1218. The second sheet front surface 1210 is distinguished into a second sheet first surface/second surface 1219, and the second sheet back surface 1211 is distinguished into a second sheet third surface 1220 and a second sheet fourth surface 1221. The third sheet front surface 1212 is distinguished into a third sheet first surface/second surface 1222, and the third sheet back surface 1213 is distinguished into a third sheet third surface 1223 and a third sheet fourth surface 1224. The fourth sheet front surface 1214 is distinguished into a fourth sheet first surface/second surface 1225, and the fourth sheet back surface 1215 is distinguished into a fourth sheet third surface 1226 and a fourth sheet fourth surface 1227.

Next, the total of six pages of the job data are laid out on the surfaces of the sheets in accordance with the style of particular two fold bookbinding. In the printing system according to this embodiment, in imposition processing for particular two fold bookbinding, control is performed not to impose a page image of print data of job data to a print sheet surface to be glued in particular two fold bookbinding. More specifically, as shown in FIG. 12, the second page 1203 is laid out on the first sheet first surface/second surface 1216, and the first page 1202 is laid out on the first sheet fourth surface 1218. However, no page is laid out on the first sheet third surface 1217 because it is glued by post processing. The third page 1204 is laid out on the second sheet first surface/second surface 1219. However, no pages are laid out on the second sheet third surface 1220 and the second sheet fourth surface 1221 because they are glued by post processing. The fourth page 1205 is laid out on the third sheet first surface/second surface 1222. However, no pages are laid out on the third sheet third surface 1223 and the third sheet fourth surface 1224 because they are glued by post processing. The fifth page 1206 is laid out on the fourth sheet first surface/second surface 1225, and the sixth page 1207 is laid out on the fourth sheet third surface 1226. However, no page is laid out on the fourth sheet fourth surface 1227 because it is glued by post processing.

Figure 13:
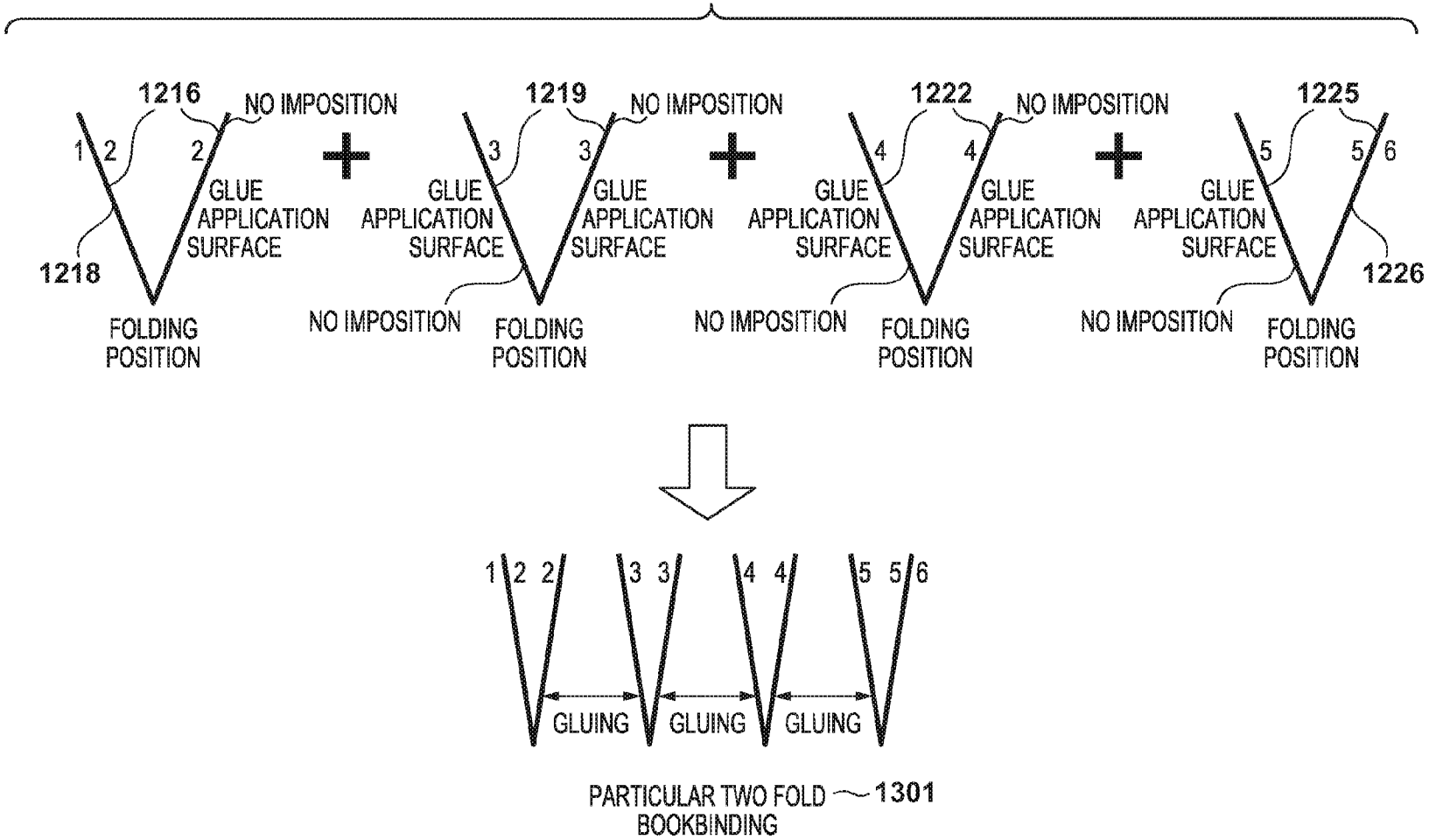
FIG. 13 is a view for explaining particular two fold bookbinding.

In imposition of particular two fold bookbinding according to this embodiment, an image processing unit 113 lays out each page on one of the surfaces of the first to fourth sheets, as shown in FIG. 13. After that, an image forming unit 122 forms an image on one or both surfaces in the order from the first sheet to the fourth sheet. The print sheets are conveyed in a printing apparatus 103 in accordance with a sheet conveyance path 209 and conveyed to a discharge unit 125. The sheets conveyed with the sheet front surfaces facing up in the order from the first sheet to the fourth sheet are two-folded (valley-folded) by the discharge unit 125. After that, one outer surface of a two-folded sheet and one outer surface of another two-folded sheet are bonded by glue manually or using another device. Particular two fold bookbinding 1301 as a final product whose pages are turned from the left side is thus completed. The print page layout method of the image processing unit 113, the image forming order of the image forming unit 122, and the stack order or stack surface of the print products to the discharge unit 125 are not limited to those of the embodiment, and can be changed as long as the particular two fold bookbinding as the final product has a consistent page order.

In this embodiment, as described with reference to FIG. 11, if YES in step S1103, the process advances to step S1104. A print job processing unit 115 instructs the image processing unit 113 to perform image processing by performing imposition of particular two fold bookbinding for the print job. Upon receiving the instruction, the image processing unit 113 computes the necessary number of sheets by an arithmetic expression "(total number of print pages−2)/2". Note that when computing the necessary number of sheets, page units need to be uniformed. As in this embodiment, if the job data includes a total of six pages, and four pages include pages of two surfaces each, the number of pages is doubled, and the necessary number of sheets is computed by setting the total number of pages to 10.

As described above, according to this embodiment, in addition to the effect of the first embodiment, it is possible to cope with a case in which job data includes a page in a spread state in particular two fold bookbinding. The printing system can be adapted to various print jobs and improve the convenience.

Third Embodiment

The third embodiment of the present invention will be described below in detail with reference to the accompanying drawings. Note that in this embodiment, only differences from the first embodiment will mainly be described, and a repetitive description will be omitted.

In the first embodiment, concerning a print job processed by the printing system, in imposition processing for particular two fold bookbinding, a page image of print data of job data is not imposed to a print sheet surface to be glued in particular two fold bookbinding. However, when particular two fold bookbinding is performed in this way, sheet portions that are not glued, that is, sheets that are the first and last sheets concerning the print order upon particular two fold bookbinding as a print product are different from other glued sheets in quality such as the strength, thickness, or appearance.

In this embodiment, when each print sheet is divided into two, left and right surfaces on each of the front and back surfaces, that is, a total of four surfaces, pages can be imposed to the surfaces in accordance with the print sheet, and two pages can be imposed at maximum to a total of two surfaces of each print sheet used for particular two fold bookbinding. In addition, print image data is generated without imposing pages to surfaces to be glued in particular two fold bookbinding. The first page of a print job is arranged as the front cover on one surface of a print sheet having the same size as the finished size after two folding in particular two fold bookbinding. Also, the final page of the print job is arranged as the back cover on one surface of another print sheet having the same size as the finished size after two folding in particular two fold bookbinding. Print image data is thus generated so that the final print product has a proper page order. In addition to the first embodiment, the printing system can thus improve the degree or quality of particular two fold bookbinding as a final print product.

<Particular Two Fold Bookbinding>

Figure 14:
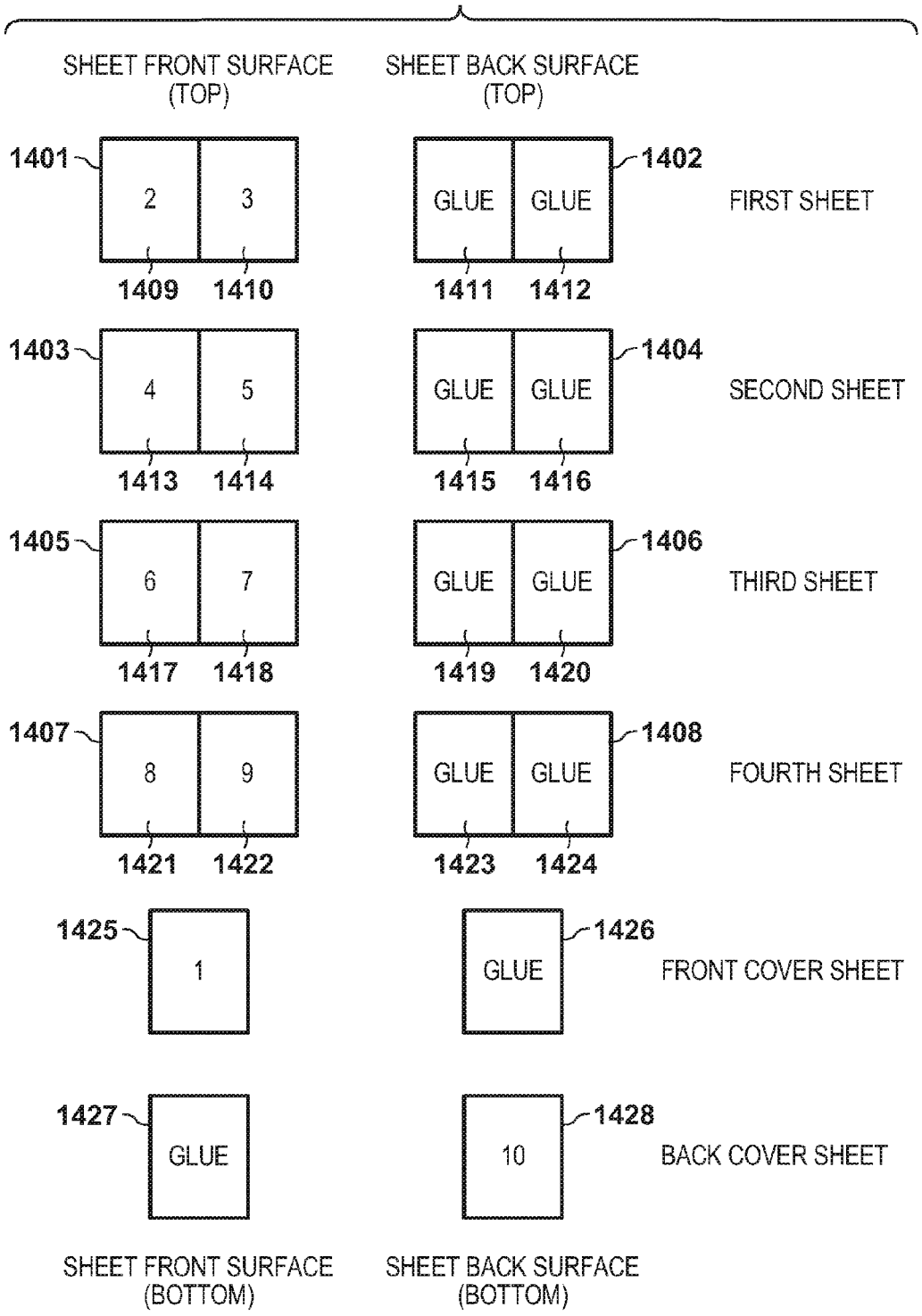
FIG. 14 is a view for explaining imposition of particular two fold bookbinding.

Imposition of particular two fold bookbinding according to this embodiment will be described with reference to FIG. 14. In a case in which out of the print attribute information of a print job, an imposition instruction instructs particular two fold bookbinding for job data including, for example, a total of 10 pages, each print sheet is distinguished into a sheet front surface and a sheet back surface for convenience's sake, as described with reference to FIG. 4. That is, as shown in FIG. 14, the print sheets are distinguished into a first sheet front surface 1401, a first sheet back surface 1402, a second sheet front surface 1403, a second sheet back surface 1404, a third sheet front surface 1405, a third sheet back surface 1406, a fourth sheet front surface 1407, and a fourth sheet back surface 1408. In addition, a front cover sheet is distinguished into a front cover sheet front surface 1425 and a front cover sheet back surface 1426, and a back cover sheet is distinguished into a back cover sheet front surface 1427 and a back cover sheet back surface 1428. Both the front cover sheet and the back cover sheet are print sheets having the same size as the finished size after two folding in particular two fold bookbinding. Note that in this embodiment, the job data includes a total of 10 pages. However, any number of pages that can be handled by the printing system can be set.

Next, as described with reference to FIG. 4, each print sheet is distinguished such that pages can be laid out on two, left and right surfaces of each of the front surface and the back surface of the print sheet. That is, as shown in FIG. 14, the first sheet front surface 1401 is distinguished into a first sheet first surface 1409 and a first sheet second surface 1410, and the first sheet back surface 1402 is distinguished into a first sheet third surface 1411 and a first sheet fourth surface 1412. The second sheet front surface 1403 is distinguished into a second sheet first surface 1413 and a second sheet second surface 1414, and the second sheet back surface 1404 is distinguished into a second sheet third surface 1415 and a second sheet fourth surface 1416. The third sheet front surface 1405 is distinguished into a third sheet first surface 1417 and a third sheet second surface 1418, and the third sheet back surface 1406 is distinguished into a third sheet third surface 1419 and a third sheet fourth surface 1420. The fourth sheet front surface 1407 is distinguished into a fourth sheet first surface 1421 and a fourth sheet second surface 1422, and the fourth sheet back surface 1408 is distinguished into a fourth sheet third surface 1423 and a fourth sheet fourth surface 1424. Note that in this embodiment, each the front cover sheet and the back cover sheet need not always be distinguished to lay out two pages because a plurality of pages are not imposed.

Next, the total of 10 pages of the job data are laid out on the surfaces of the sheets in accordance with the style of particular two fold bookbinding. In the printing system according to this embodiment, in imposition processing for particular two fold bookbinding, control is performed not to impose a page image of print data of job data to a print sheet surface to be glued in particular two fold bookbinding. More specifically, as shown in FIG. 14, the second page is laid out on the first sheet first surface 1409, and the third page is laid out on the first sheet second surface 1410. However, no pages are laid out on the first sheet third surface 1411 and the first sheet fourth surface 1412 because they are glued by post processing. The fourth page is laid out on the second sheet first surface 1413, and the fifth page is laid out on the second sheet second surface 1414. However, no pages are laid out on the second sheet third surface 1415 and the second sheet fourth surface 1416 because they are glued by post processing. The sixth page is laid out on the third sheet first surface 1417, and the seventh page is laid out on the third sheet second surface 1418. However, no pages are laid out on the third sheet third surface 1419 and the third sheet fourth surface 1420 because they are glued by post processing. The eighth page is laid out on the fourth sheet first surface 1421, and the ninth page is laid out on the fourth sheet second surface 1422. However, no pages are laid out on the fourth sheet third surface 1423 and the fourth sheet fourth surface 1424 because they are glued by post processing. The first page is laid out on the front cover sheet front surface 1425, and the 10th page is laid out on the back cover sheet back surface 1428. However, no pages are laid out on the front cover sheet back surface 1426 and the back cover sheet front surface 1427 because they are glued by post processing.

Figure 15:
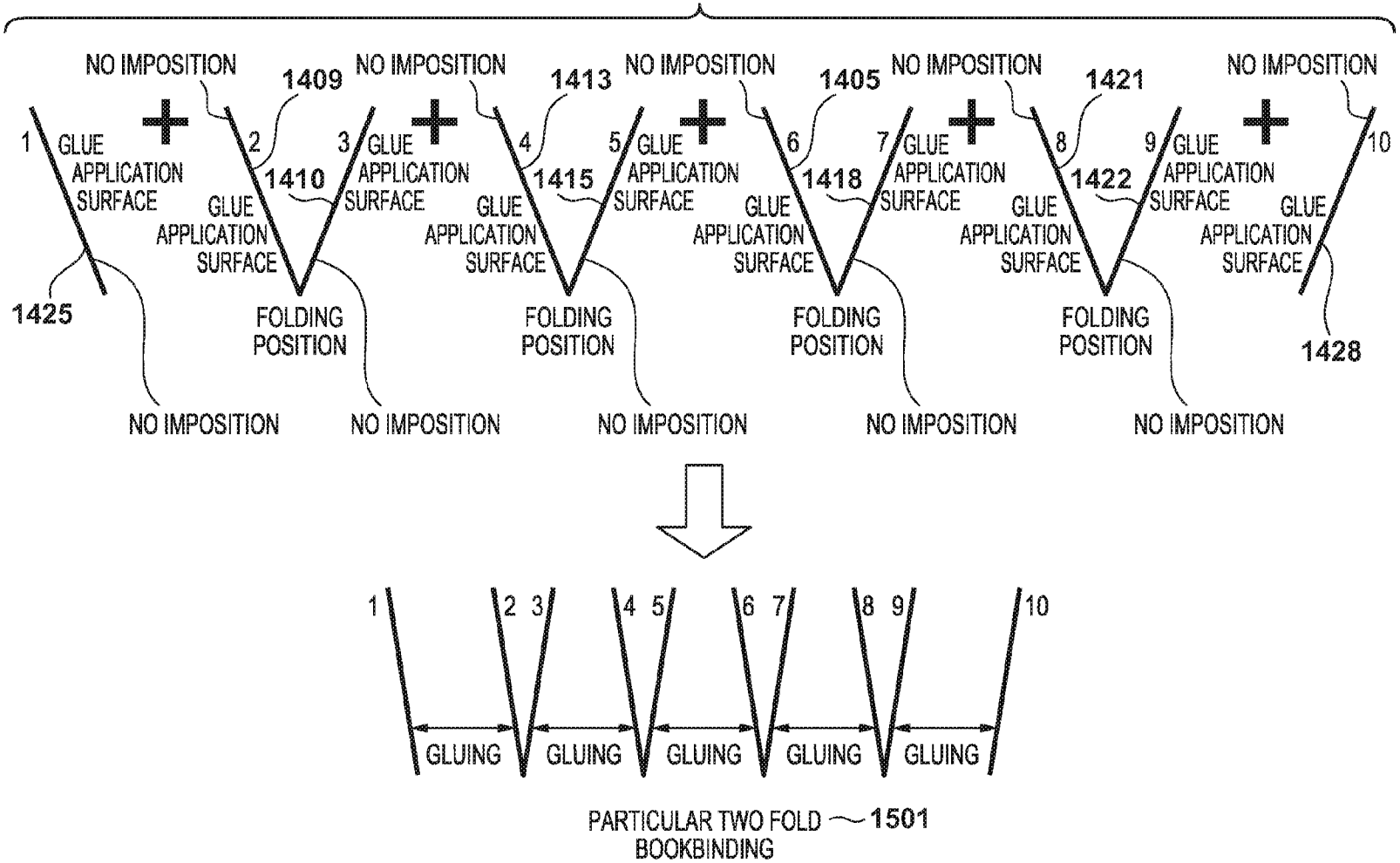
FIG. 15 is a view for explaining particular two fold bookbinding.

In imposition of particular two fold bookbinding according to this embodiment, an image processing unit 113 lays out each page on one of the surfaces of the first to fourth sheets, the front cover sheet, and the back cover sheet, as shown in FIG. 15. After that, an image forming unit 122 forms an image on one or both surfaces in the order of the front cover sheet, the first sheet to the fourth sheet, and the back cover sheet. The print sheets are conveyed in a printing apparatus 103 in accordance with a sheet conveyance path 209 and conveyed to a discharge unit 125. The sheets conveyed with the sheet front surfaces facing up in the order from the first sheet to the fourth sheet are two-folded (valley-folded) by the discharge unit 125. After that, the outer surfaces of two adjacent two-folded sheets are bonded by glue manually or using another device. In addition, one surface of the front cover sheet having the half size of a two-folded sheet and the other outer surface of the two-folded sheet adjacent to the front cover sheet are bonded by glue. Similarly, one surface of the back cover sheet and the other outer surface of the two-folded sheet adjacent to the back cover sheet are bonded by glue. Particular two fold bookbinding 1501 as a final product whose pages are turned from the left side is thus completed. The print page layout method of the image processing unit 113, the image forming order of the image forming unit 122, and the stack order or stack surface of the print products to the discharge unit 125 are not limited to those of the embodiment, and can be changed as long as the particular two fold bookbinding as the final product has a consistent page order.

As described above, according to this embodiment, in addition to the effect of the first embodiment, it is possible to cope with a layout that adds the front cover and the back cover in particular two fold bookbinding and improve the degree or quality of particular two fold bookbinding as a final print product.

Fourth Embodiment

The third embodiment of the present invention will be described below in detail with reference to the accompanying drawings. Note that in this embodiment, only differences from the first embodiment will mainly be described, and a repetitive description will be omitted.

In the first embodiment, concerning a print job processed by the printing system, in imposition processing for particular two fold bookbinding, a page image of print data of job data is not imposed to a print sheet surface to be glued in particular two fold bookbinding. However, when particular two fold bookbinding is performed in this way, sheet portions that are not glued, that is, sheets that are the first and last sheets concerning the print order upon particular two fold bookbinding as a print product are different from other glued sheets in quality such as the strength, thickness, or appearance.

In this embodiment, when each print sheet is divided into two, left and right surfaces on each of the front and back surfaces, that is, a total of four surfaces, pages can be imposed to the surfaces in accordance with the print sheet, and two pages can be imposed at maximum to a total of two surfaces of each print sheet used for particular two fold bookbinding. In addition, the first page of a print job is imposed as the front cover to one surface out of a total of four surfaces of a print sheet having a size at least larger than that of a print sheet used for particular two fold bookbinding. Furthermore, the final page of the print job is imposed to another surface as the back cover. No pages are imposed to surfaces to be glued in particular two fold bookbinding. Print image data is generated such that a final print product has a consistent page order. In addition to the effect of the first embodiment, the printing system can thus improve the degree or quality of particular two fold bookbinding as a final print product.

<Particular Two Fold Bookbinding>

Figure 16:
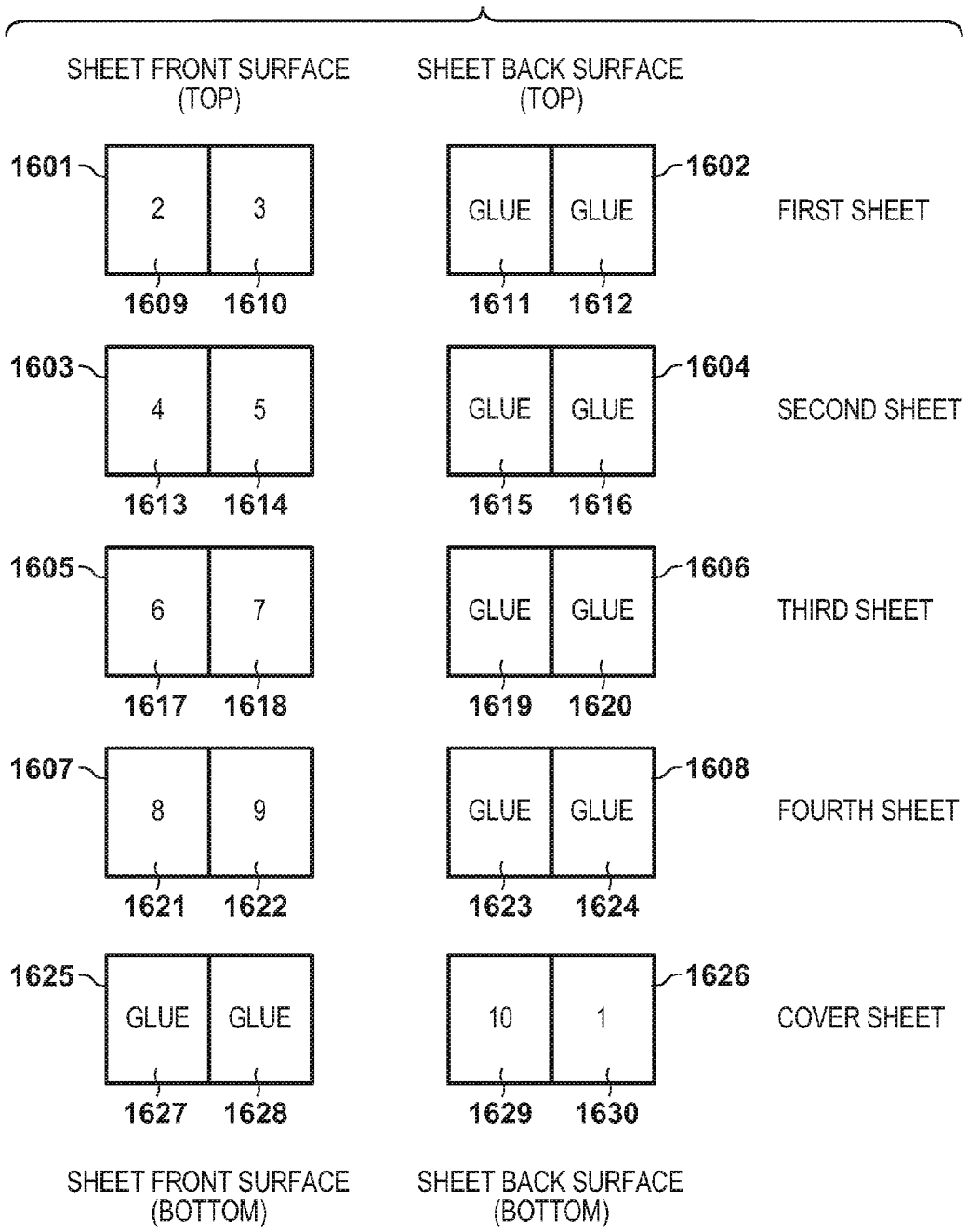
FIG. 16 is a view for explaining imposition of particular two fold bookbinding.

Imposition of particular two fold bookbinding according to this embodiment will be described with reference to FIG. 16. In a case in which out of the print attribute information of a print job, an imposition instruction instructs particular two fold bookbinding for job data including, for example, a total of 10 pages, each print sheet is distinguished into a sheet front surface and a sheet back surface for convenience's sake, as described with reference to FIG. 4. That is, as shown in FIG. 16, the print sheets are distinguished into a first sheet front surface 1601, a first sheet back surface 1602, a second sheet front surface 1603, a second sheet back surface 1604, a third sheet front surface 1605, a third sheet back surface 1606, a fourth sheet front surface 1607, and a fourth sheet back surface 1608. In addition, a cover sheet is distinguished into a cover sheet front surface 1625 and a cover sheet back surface 1626. The cover sheet is a print sheet having a size at least larger than that of the print sheet used for particular two fold bookbinding. Note that in this embodiment, the job data includes a total of 10 pages. However, any number of pages that can be handled by the printing system can be set.

Next, as described with reference to FIG. 4, each print sheet is distinguished such that pages can be laid out on two, left and right surfaces of each of the front surface and the back surface of the print sheet. That is, as shown in FIG. 16, the first sheet front surface 1601 is distinguished into a first sheet first surface 1609 and a first sheet second surface 1610, and the first sheet back surface 1602 is distinguished into a first sheet third surface 1611 and a first sheet fourth surface 1612. The second sheet front surface 1603 is distinguished into a second sheet first surface 1613 and a second sheet second surface 1614, and the second sheet back surface 1604 is distinguished into a second sheet third surface 1615 and a second sheet fourth surface 1616. The third sheet front surface 1605 is distinguished into a third sheet first surface 1617 and a third sheet second surface 1618, and the third sheet back surface 1606 is distinguished into a third sheet third surface 1619 and a third sheet fourth surface 1620. The fourth sheet front surface 1607 is distinguished into a fourth sheet first surface 1621 and a fourth sheet second surface 1622, and the fourth sheet back surface 1608 is distinguished into a fourth sheet third surface 1623 and a fourth sheet fourth surface 1624. The cover sheet front surface 1625 is distinguished into a cover sheet first surface 1627 and a cover sheet second surface 1628, and the cover sheet back surface 1626 is distinguished into a cover sheet third surface 1629 and a cover sheet fourth surface 1630.

Next, the total of 10 pages of the job data are laid out on the surfaces of the sheets in accordance with the style of particular two fold bookbinding. In the printing system according to this embodiment, in imposition processing for particular two fold bookbinding, control is performed not to impose a page image of print data of job data to a print sheet surface to be glued in particular two fold bookbinding. More specifically, as shown in FIG. 16, the second page is laid out on the first sheet first surface 1609, and the third page is laid out on the first sheet second surface 1610. However, no pages are laid out on the first sheet third surface 1611 and the first sheet fourth surface 1612 because they are glued by post processing. The fourth page is laid out on the second sheet first surface 1613, and the fifth page is laid out on the second sheet second surface 1614. However, no pages are laid out on the second sheet third surface 1615 and the second sheet fourth surface 1616 because they are glued by post processing. The sixth page is laid out on the third sheet first surface 1617, and the seventh page is laid out on the third sheet second surface 1618. However, no pages are laid out on the third sheet third surface 1619 and the third sheet fourth surface 1620 because they are glued by post processing. The eighth page is laid out on the fourth sheet first surface 1621, and the ninth page is laid out on the fourth sheet second surface 1622. However, no pages are laid out on the fourth sheet third surface 1623 and the fourth sheet fourth surface 1624 because they are glued by post processing. The 10th page is laid out on the cover sheet third surface 1629, and the first page is laid out on the cover sheet fourth surface 1630. However, no pages are laid out on the cover sheet first surface 1627 and the cover sheet second surface 1628 because they are glued by post processing.

Figure 17:
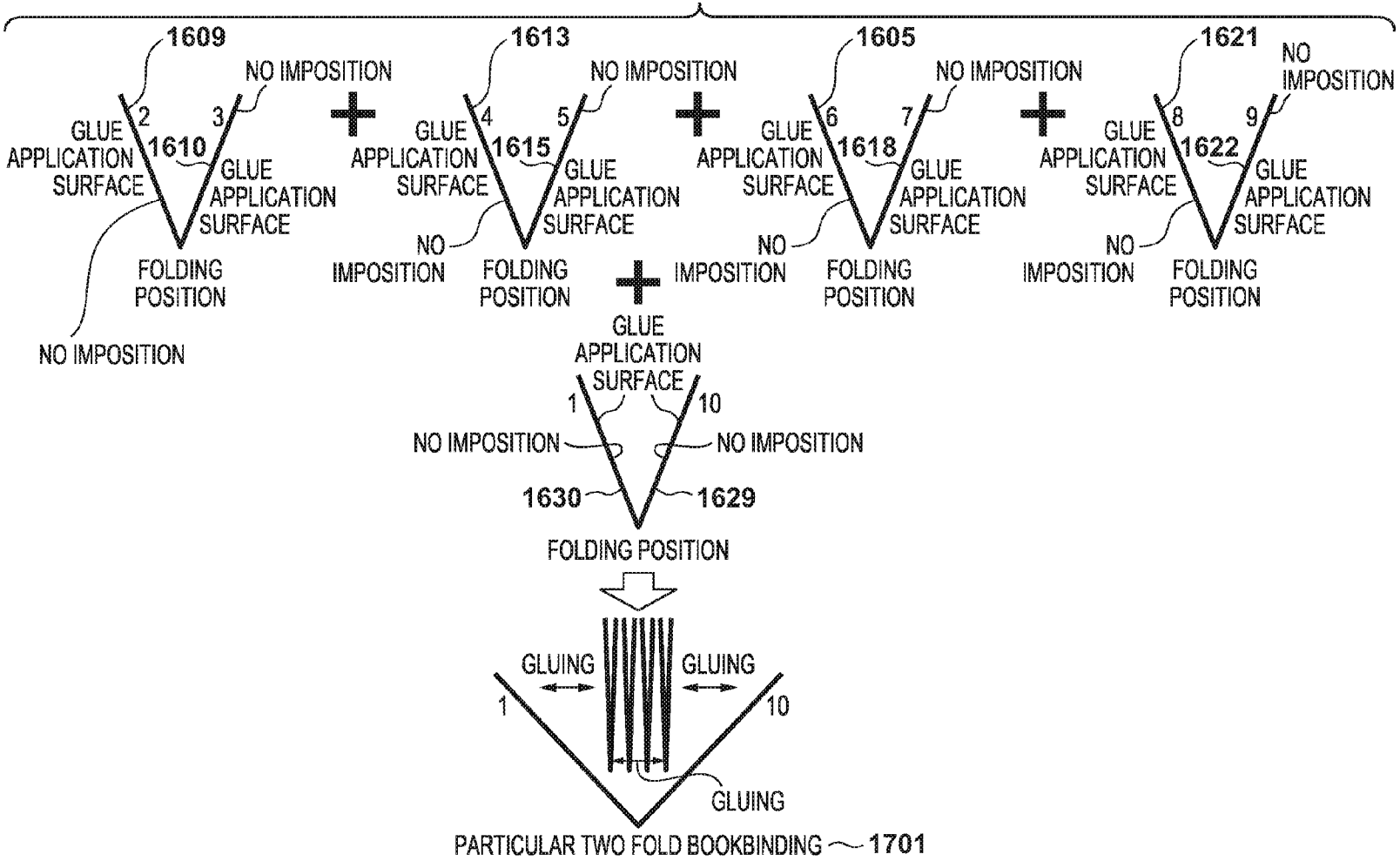
FIG. 17 is a view for explaining particular two fold bookbinding.

In imposition of particular two fold bookbinding according to this embodiment, an image processing unit 113 lays out each page on one of the surfaces of the first to fourth sheets and the cover sheet, as shown in FIG. 17. An image forming unit 122 forms an image on one or both surfaces in the order of the first sheet to the fourth sheet and the cover sheet. The print sheets are conveyed in a printing apparatus 103 in accordance with a sheet conveyance path 209 and conveyed to a discharge unit 125. The sheets conveyed with the sheet front surfaces facing up in the order of the first sheet to the fourth sheet and the cover sheet are two-folded (valley-folded) by the discharge unit 125. Additionally, in the first to fourth sheets, the outer surfaces of two adjacent two-folded sheets are bonded by glue manually or using another device. Then, the inner surface of the cover sheet and the outer surfaces of the first and fourth sheets are bonded by glue such that the bundle of sheets bonded by glue is wrapped by the cover sheet. Particular two fold bookbinding 1701 as a final product whose pages are turned from the left side is thus completed. The print page layout method of the image processing unit 113, the image forming order of the image forming unit 122, and the stack order or stack surface of the print products to the discharge unit 125 are not limited to those of the embodiment, and can be changed as long as the particular two fold bookbinding as the final product has a consistent page order.

As described above, according to this embodiment, in addition to the effect of the first embodiment, it is possible to cope with a layout that adds the cover sheet in particular two fold bookbinding and improve the degree or quality of particular two fold bookbinding as a final print product.

Note that in this embodiment, the sheets are two-folded by the discharge unit 125. However, if the discharge unit 125 does not have the two folding function, image formation on the sheets may be performed assuming that the folding processing is not performed by the system shown in FIG. 2, and the two folding is performed by another folding device.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-147082 filed on Jul. 24, 2015, which is hereby incorporated by reference herein in its entirety.

What is claimed is:

1. An image processing apparatus for a bookbinding printing, the apparatus comprising:

a receiver that receives a print job having print data of a plurality of pages; and a processor that is capable of imposing print data to a first area which is a half area on one surface of a front and back of a recording sheet on which print data is to be printed, a second area which is another half area on the one surface, a third area which is a half area on another surface of the front and back of the recording sheet, and a fourth area which is another half area on the another surface, wherein in a case where a predetermined bookbinding mode has been set to the print job, the processor:

(a) imposes print data to the first, third, and fourth areas on a first recording sheet on which a first page of the print job is to be printed, and does not impose print data to the second area on the first recording sheet, (b) imposes print data to the third and fourth areas on a second recording sheet on which fourth and subsequent pages of the print job are to be printed, and does not impose print data to the first and second areas on the second recording sheet, and (c) imposes print data to at least the third area among the second, third, and fourth areas on a third recording sheet on which the last page of the print job is to be printed, and does not impose print data to the first area on the third recording sheet.

2. The apparatus according to claim 1, wherein the processor:

imposes print data corresponding to a first page of the print job to the first area on the first recording sheet;

imposes print data corresponding to a second page of the print job to the third area on the first recording sheet;

imposes print data corresponding to a third page of the print job to the fourth area on the first recording sheet;

imposes print data corresponding to a fourth page of the print job to the third area on the second recording sheet; and imposes print data corresponding to a fifth page of the print job to the fourth area on the second recording sheet.

3. The apparatus according to claim 1, wherein the processor, in a case where a printing size of print data corresponding to a first page of the print job is a first size and a printing size of print data corresponding to a second page of the print job is a second size being twice the first size, (a) imposes print data corresponding to the first page of the print job to the first area on the first recording sheet, and (b) imposes print data corresponding to the second page of the print job to the third and fourth areas on the first recording sheet.

4. The apparatus according to claim 1, wherein the processor imposes print data corresponding to the fourth and subsequent pages so that the number of the second recording sheets is changed in accordance with the number of pages of print data of the print job.

5. The apparatus according to claim 1, further comprising a printer that executes a printing for a recording sheet based on print data imposed by the processor.

6. The apparatus according to claim 5, further comprising a folding device that executes two-folding of a recording sheet printed by the printer.

7. An image processing apparatus for a bookbinding printing, the apparatus comprising:

a receiver that receives a print job having print data of a plurality of pages; and a processor that is capable of imposing print data to a first area which is a half area on one surface of a front and back of a recording sheet, having a first size, on which print data is to be printed, a second area which is another half area on the one surface, a third area which is a half area on another surface of the front and back of the recording sheet, and a fourth area which is another half area on the another surface, and imposing print data of one page to each of the front and back surface of a recording sheet having a second size being a half size of the first size, wherein in a case where a predetermined bookbinding mode has been set to the print job, the processor:

(a) imposes print data corresponding to a first page to a first surface on a first recording sheet on which print data corresponding to the first page of the print job is to be printed, and does not impose print data to a second surface on the first recording sheet, a size of the first recording sheet being the second size, (b) imposes print data corresponding to second and subsequent pages to the third and fourth areas on a second recording sheet on which print data corresponding to the second and subsequent pages of the print job is to be printed, and does not impose print data to the first and second areas on the second recording sheet, a size of the second recording sheet being the first size, and (c) imposes print data corresponding to the last page to a second surface on a third recording sheet on which print data corresponding to the last page of the print job is to be printed, and does not impose print data to a first surface on the third recording sheet, a size of the third recording sheet being the second size.

8. The apparatus according to claim 7, wherein the processor imposes print data corresponding to a second page of the print job to the third area on the second recording sheet, and imposes print data corresponding to a third page to the fourth area on the second recording sheet.

9. The apparatus according to claim 7, wherein the processor imposes print data corresponding to the second and subsequent pages so that the number of the second recording sheets is changed in accordance with the number of pages of print data of the print job.

10. The apparatus according to claim 7, further comprising a printer that executes a printing for a recording sheet based on print data imposed by the processor.

11. The apparatus according to claim 10, further comprising a folding device that executes two-folding of the first recording sheet printed by the printer.

12. An image processing apparatus for a bookbinding printing, the apparatus comprising:

a receiver that receives a print job having print data of a plurality of pages; and a processor that is capable of imposing print data to a first area which is a half area on one surface of a front and back of a recording sheet on which print data is to be printed, a second area which is another half area on the one surface, a third area which is a half area on another surface of the front and back of the recording sheet, and a fourth area which is another half area on the another surface, wherein in a case where a predetermined bookbinding mode has been set to the print job, the processor:

(a) imposes print data corresponding to a first page to the first area on a first recording sheet on which print data corresponding to the first page of the print job is to be printed, imposes print data corresponding to the last page of the print job to the second area on the first recording sheet, and does not impose print data to the third and fourth areas on the first recording sheet, a size of the first recording sheet being the first size, and (b) imposes print data corresponding to the second and subsequent pages to the third and fourth areas on a second recording sheet on which print data corresponding to the second and subsequent pages of the print job is to be printed, and does not impose print data to the first and second areas on the second recording sheet, a size of the second recording sheet being a second size being smaller than the first size.

13. The apparatus according to claim 12, wherein the processor imposes print data corresponding to a second page of the print job to the third area on the second recording sheet, and imposes print data corresponding to a third page to the fourth area on the second recording sheet.

14. The apparatus according to claim 12, wherein the processor imposes print data corresponding to the second and subsequent pages so that the number of the second recording sheets is changed in accordance with the number of pages of print data of the print job.

15. The apparatus according to claim 12, further comprising a printer that executes a printing for a recording sheet based on print data imposed by the processor.

16. The apparatus according to claim 15, further comprising a folding device that executes two-folding of the first recording sheet printed by the printer.

* * * * *